US005545268A

United States Patent [19]

Yashiki et al.

[11] Patent Number: 5,545,268

[45] Date of Patent: Aug. 13, 1996

[54] SURFACE TREATED METAL MEMBER EXCELLENT IN WEAR RESISTANCE AND ITS MANUFACTURING METHOD

[75] Inventors: Takashi Yashiki; Yasunori Wada; Hidenori Nishimoto, all of Kobe; Yoshinori Terada, Tokyo; Takenori Nakayama, Kobe; Tadashi Abumiya, Tokyo, all of Japan

[73] Assignee: Kabushiki Kaisha Kobe Seiko Sho, Kobe, Japan

[21] Appl. No.: 448,026

[22] Filed: May 23, 1995

[30] Foreign Application Priority Data

May 25, 1994 [JP] Japan ..... 6-111395
Dec. 28, 1994 [JP] Japan ..... 6-328540

[51] Int. Cl.[6] ..... C25D 5/50

[52] U.S. Cl. ..... 148/518; 148/527; 205/222; 205/227

[58] Field of Search ..... 148/518, 527, 148/537; 205/222, 227

[56] References Cited

U.S. PATENT DOCUMENTS

| | | | |
|---|---|---|---|
| 4,687,556 | 8/1987 | Sutton et al. | 148/518 |
| 4,909,859 | 3/1990 | Nazmy et al. | 148/518 |
| 4,914,796 | 4/1990 | Lioy et al. | 205/222 |
| 5,116,430 | 5/1992 | Hirai et al. | 148/518 |

OTHER PUBLICATIONS

*Metals Handbook*, 9th edition, vol. 4, pp. 3–5, 647–496, 754–759, and 763–769, ASM, 1981.

*Primary Examiner*—George Wyszomierski
*Attorney, Agent, or Firm*—Oblon, Spivak, McClelland, Maier & Neustadt, P.C.

[57] ABSTRACT

Disclosed is a method of manufacturing a surface treated metal member excellent in wear resistance, comprising the steps of: applying Ni—P electroplating on the surface of a metal base member and heat-treating the metal base member; and blasting, on the surface of the metal base member, fine particles having nearly spherical shapes and having an average particle size of 10–400 μm.

3 Claims, 11 Drawing Sheets

SURFACE TREATED METAL MEMBER EXCELLENT IN WEAR RESISTANCE AND ITS MANUFACTURING METHOD

BACKGROUND OF THE INVENTION

1. Field of the Invention

The present invention relates to a surface treated metal member having an excellent resistance against sliding wear, rolling wear, line wear, wear fatigue and the like, and its manufacturing method. The surface treated metal member is useful for sliding members for an automobile, motor-bicycle (two-wheeled vehicle), bicycle and the like such as a connecting rod, connecting rod pin, piston head, valve spring retainer, seat rail, inner sleeve, oil pump, valve lifter, crank shaft, and cylinder liner; spring members such as a valve spring; gear members such as a bicycle gear and motor-bicycle sprocket; shaft members contact with various bearings such as a bicycle rear pulley, bicycle pedal shaft, automobile crank shaft; and contact parts with power transmission members. Also, such a metal member is suitable for jig and tool members such as a screw and press die; and compressor members of scrolls. In addition, it is useful for non-power transmission members such as an automobile wheel, golf head, and plate member of a cooking hot plate, and further it is effectively used as a means for increasing wear resistance and corrosion resistance.

2. Description of the Related Art

Ti or a Ti alloy (sometimes, represented by a Ti alloy), Al or an Al alloy is a lightweight material having an excellent specific strength. These alloys, therefore, have been extensively used for structural members in the chemical industrial field, and in airplane and space transport field. In particular, as transport machines including automobiles have been highly graded, functions such as comfortable running and safety running have been required to be enhanced, and as a consequence the number of additional function portions have been further increased. This presents a problem in increasing a vehicular weight. On the other hand, it has been further required to reduce fuel consumption and exhaust gas by lightweightness of vehicular bodies. To solve these problems, the conventional steel materials have come to be replaced with Ti or Al alloys as lightweight metal materials.

These alloys, however, have a disadvantage in that it is poor in wear resistance and seizure resistance, and accordingly, for sliding members and shaft members of machines, an attempt for enhancing the wear resistance of these alloys have been made by applying, on the surface of, for example, the Ti alloy, wet-plating such as Ni—P plating or Cr plating, thermal diffusion such as ion nitriding and boronizing, overlaying or thermal spraying. In case of Al alloys, anodings or some platings have been applied in order to improve their wear resistance. However, in wet-plating such as Ni—P plating or Cr plating, the hardness and toughness of a plating layer are low, so that the wear resistance is insufficient. On the other hand, in case of Ti or Ti alloys, thermal diffusion such as ion nitriding and boronizing requires the treatment for a long time at a high temperature (about 1000° C.), tending to coarsen crystal grains by the growth of crystal grains and hence to deteriorate mechanical properties. In thermal spraying, a large deformation is easily generated due to thermal strain; cracking is possibly generated in weld and bonding failure is sometimes generated; secondary machining such as grinding is required after welding; and fine members are difficult to be processed.

The methods of improving the wear resistance of, for example, a Ti alloy have many problems. Of these methods, wet-plating such as Ni—P plating or Cr plating has a possibility in relatively easily improving the wear resistance by taking a good balance between the hardness and toughness of the plating layer. In particular, to enhance the wear resistance of a Ti alloy, a method using Ni—P plating being excellent in toughness, lubricity and precipitating efficiency has been proposed. Specifically, in this method, Ni—P plating is combined with heat-treatment, and further with the subsequent blasting of fine particles such as shot peening or dry honing (hereinafter, sometimes referred to as "honing treatment"). For example, a technique of heat-treating a Ni—P plating layer has been disclosed in Unexamined Japanese Patent Publication No. HEI 2-221377. A technique of heat-treating a Ni—P plating layer, and then blasting fine particles to the surface of the plating layer by shot-peening or dry honing has been disclosed in Unexamined Japanese Patent Publication Nos. HEI 2-133578, SHO 63-312982 and HEI 1-159358. In addition, similar techniques have been also disclosed in Unexamined Japanese Patent Publication Nos. HEI 4-246181 and HEI 5-78859.

Incidentally, the heat-treatment adopted in the above-described techniques is intended to increase the hardness of a Ni—P plating layer or form a mutual diffusion layer at the interface between the plating layer and the base member, and hence to improve the adhesiveness therebetween; however, the disclosed heat-treatment condition in the above-described references is set to increase the hardness of a plating layer, and during this heat-treatment a large tensile strength is generated on the plating layer, thereby deteriorating the toughness. Moreover, the adhesiveness is slightly improved by the formation of the diffusion layer at the interface between the plating layer and the base member by heat-treatment; however, the amount of the diffusion layer is insufficient to significantly improve the wear resistance.

On the other hand, shot peening or dry honing performed after heat-treatment is intended to impart a residual compressive stress on the plating layer reduced in toughness by heat-treatment for recovering the toughness, and to enhance the fatigue strength of the base member using the hoop fastening effect of the plating layer. However, the residual compressive stress applied to the plating layer tends to be insufficient and thereby the toughness is difficult to be recovered, and further cracks are easily generated from the damaged portions formed on the surface upon shot peening, thus failing to sufficiently improve the wear resistance.

SUMMARY OF THE INVENTION

An object of the present invention is to solve the above-described problems of the prior art, and to provide a surface treated metal member being excellent in wear resistance and its manufacturing method.

To achieve the above object, according to the present invention, there is provided a method of manufacturing a surface treated metal member excellent in wear resistance, comprising the steps of: applying Ni—P electroplating on the surface of a metal base member and heat-treating said metal base member; and blasting, on the surface of said metal base member, fine particles having nearly spherical shapes and having an average particle size of 10–400 μm. The above-described heat-treatment is preferably performed for 0.1–2 hr at 100°–650° C., more preferably, performed for 0.1–1 hr at 500°–600° C. Moreover, prior to Ni—P electroplating, Ni—based plating is preferably applied on the surface of the metal base member to a thickness of 0.5–5 μm and then non-spherical fine particles are blasted thereon. This is effective to further enhance the adhesiveness between a Ni—P electroplating layer and a base member, and hence to further enhance wear resistance.

Specific examples of metal base members used in the present invention include Ti or a Ti alloy (in particular, (α+β) type Ti alloy or β type Ti alloy), Fe based alloy, Ni based alloy, Al based alloy. The present invention contains in claim the wear resisting surface treated metal members themselves, which are obtained by applying the above-described plating on the surfaces of the above-described metal base members.

The surface treated metal member made of Ti or a Ti alloy (in particular, (α+β) type Ti alloy or type Ti alloy) which is subjected to Ti—P plating and fine particle blasting treatment, is particularly useful for engine parts for an automobile or motor-bicycle such as a connecting rod, valve spring retainer, valve spring; and parts for a bicycle such as a pedal shaft and crank shaft. The surface treated metal member made of a Fe based alloy is particularly useful for bearings and sliding parts, and the surface treated metal member made of an Al alloy is particularly useful for a bicycle gear, chain guide, motor-bicycle sprocket, automobile valve lifter, cylinder liner, piston head, clutch cover, wheel, inner sleeve, transmission core plate, die, etc.

DETAILED DESCRIPTION OF THE PREFERRED EMBODIMENT

To enhance the wear resistance of a metal member, the surface of the metal member may be coated with a hard material. However, in the case where the hardness of the base member is very different from that of the surface coating layer, a large difference in strain between the base member and coating layer is generated when an stress is applied from the outside, to thereby cause the peeling of the surface coating layer from the metal member. On the other hand, in general, as the hardness of the material coated on the surface of the base member is increased, the toughness thereof is lowered, which tends to cause breakage due to impact and to cause fatigue breakage for a long-term operation. Accordingly, to obtain a surface treated member excellent in wear resistance, it is required to improve the adhesiveness, hardness and toughness of the surface coating layer in a good balance. On the basis of these knowledges, the present inventors have examined a method of manufacturing a wear resisting surface treated metal member, and found the fact that the adhesiveness, hardness and toughness of the surface coating layer can be improved in a good balance by adopting a method of applying Ni—P plating on a base member and heat-treating it for achieving a high hardness and a high adhesiveness of the plating layer and then by applying honing treatment to the plating layer for imparting a residual compressive stress to the plating layer for recovering the toughness reduced by the heat-treatment.

Hereinafter, the function of the present invention will be described by way of the case in which a Ti alloy or an Al alloy is subjected to wear resisting surface treatment.

A technique of applying Ni—P plating to the surface of a Ti alloy base member and further applying heat-treatment and honing treatment thereon has been disclosed in Unexamined Japanese Patent Publication Nos. HEI 2-133578, SHO 63-312982, and HEI 1-159358. The present inventors have first attempted to examine a method of manufacturing a wear resisting surface treated Ti alloy member using these disclosed techniques. However, it was confirmed that the above-described techniques fail to obtain a satisfactory wear resistance with respect to a metal member used in a severe wear condition, for example, a connecting rod, valve spring retainer, valve spring, crank shaft, and pedal shaft. Thus, the present inventor have examined the disclosed techniques again, and found that the major cause of obstructing the obtainment of the sufficient wear resistance lies in honing treatment after heat-treatment.

Figure 1:
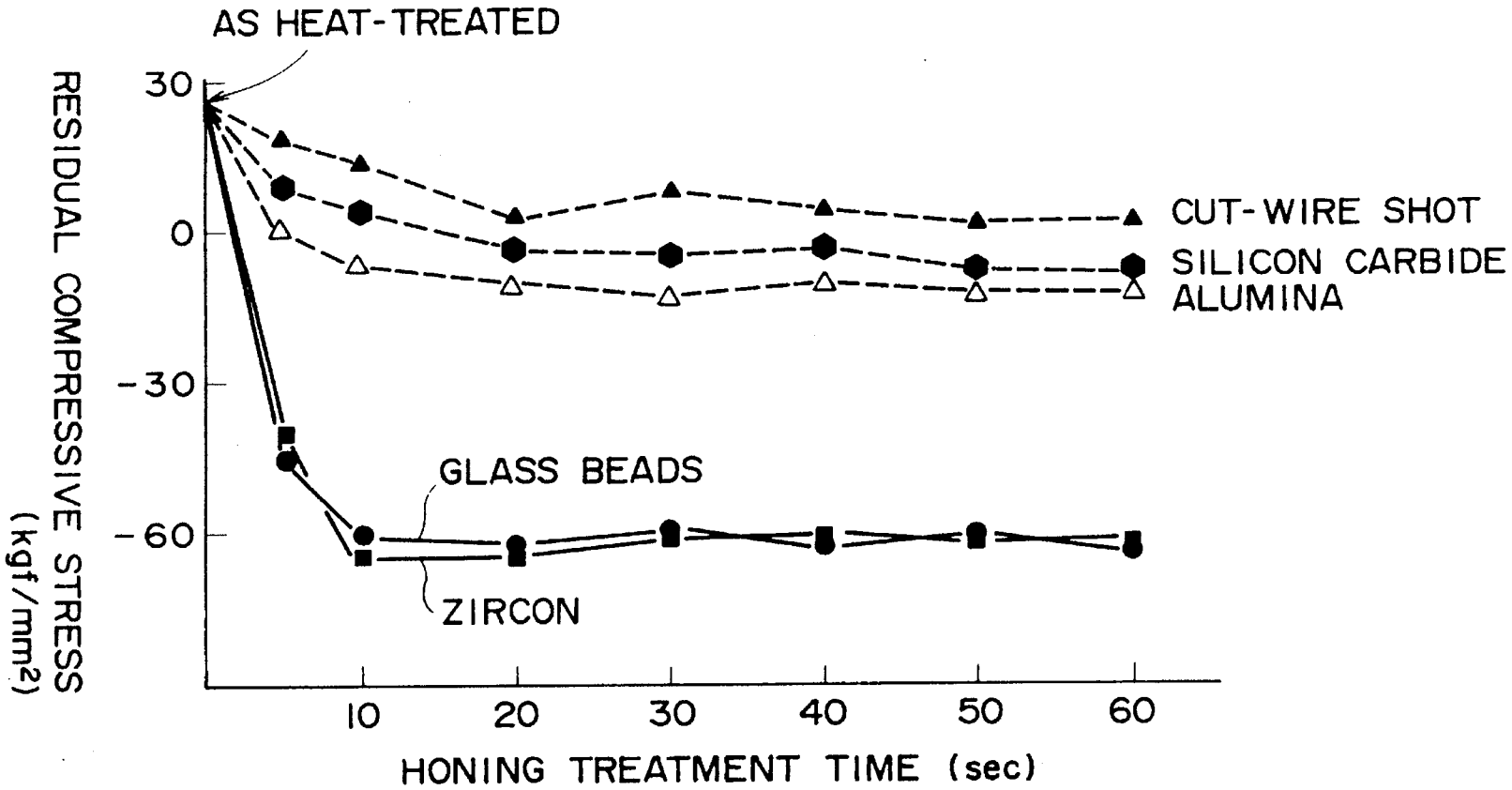
FIG. 1 is a graph showing the relationship between a honing treatment time and a residual compression stress upon honing using various kinds of fine particles.
Figure 2A:
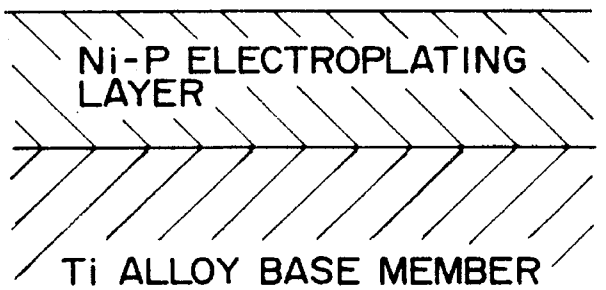
FIGS. 2*a* and 2 bare is a schematic view for illustrating the surface condition after honing treatment using non-spherical fine particles.
Figure 2B:
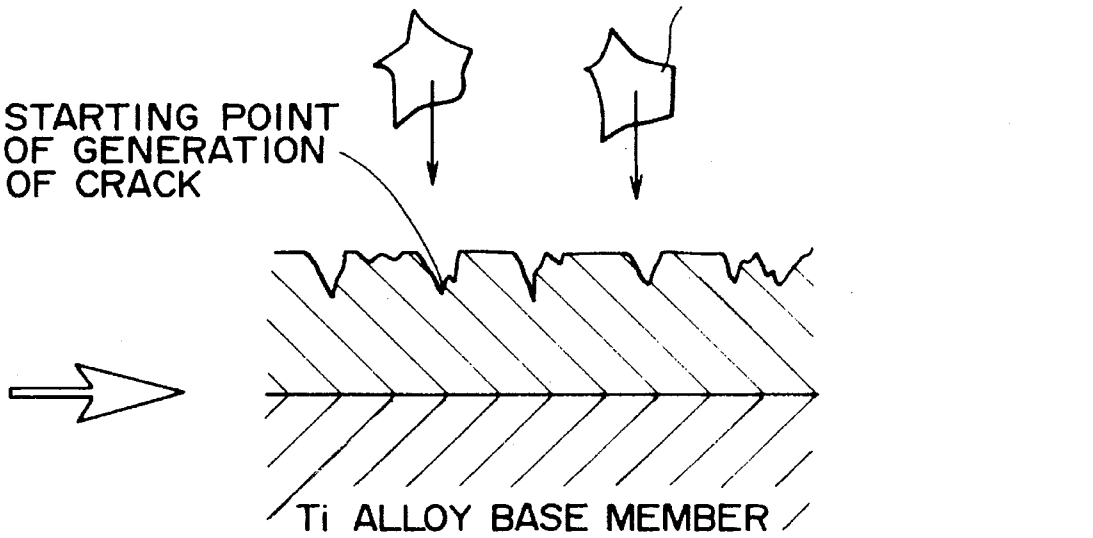
Figure 3B:
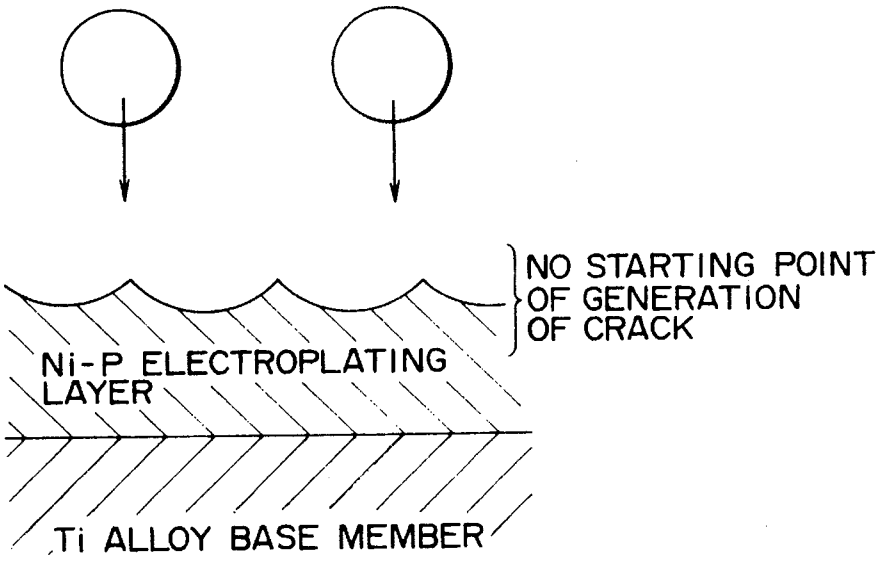
FIGS. 3*a* and 3*b* are is a schematic view for illustrating the surface condition after honing treatment using spherical fine particles.
Figure 3A:
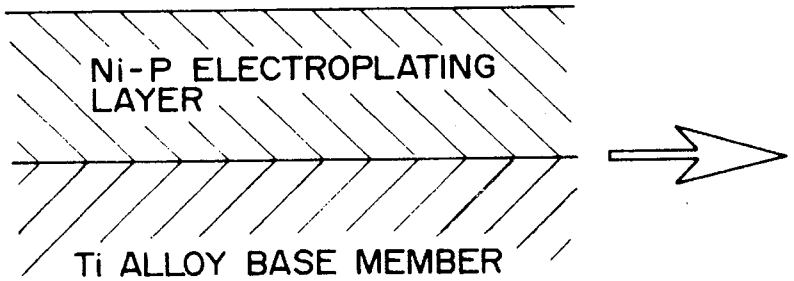

This will be described below. FIG. 1 shows the relationship between a honing treatment time and a residual compressive stress, in the case where the surface of a Ni—P electroplating layer of a test piece being already heat-treated is subjected to honing treatment using various kinds of fine particles having an average particle size of 200 μm. As is apparent from this figure, it is revealed that spherical fine particles such as glass beads or zircon are larger in the residual compressive stress removing ability than non-spherical fine particles having sharp portions such as cut-wire shots, alumina or silicon carbide. Moreover, when the above-described fine particles having sharp portions are used, the plating surface is damaged by the sharp portions of the fine particles as shown in FIGS. 2*a* and 2*b*, and the damaged portions act as the starting points of generation of cracks, leading to early wear and breakage. On the other hand, when the spherical fine particles such as glass beads or zircon grains are used, smooth irregularities are formed on the plating surface as shown in FIGS. 3*a* and 3*b*, so that the starting points of generation of cracks are not formed. As a result, it is essential to use spherical fine particles upon applying honing treatment on the surface of a plating layer formed for enhancing the wear resistance.

Figure 4A:
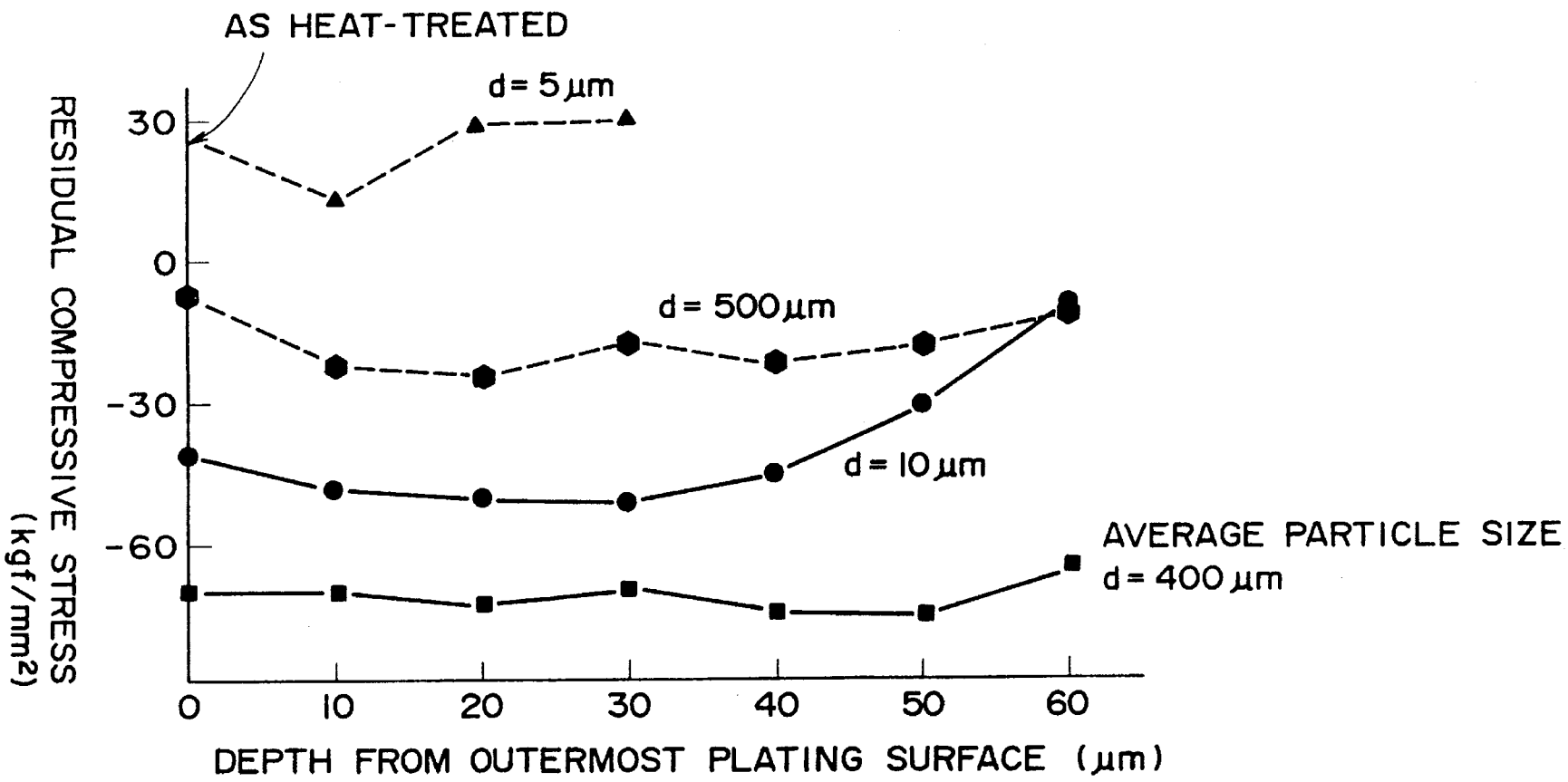
FIG. 4A is a graph showing the relationship between a depth from the plating surface and a residual compression stress upon honing treatment using spherical fine particles having different average particle sizes.
Figure 4B:
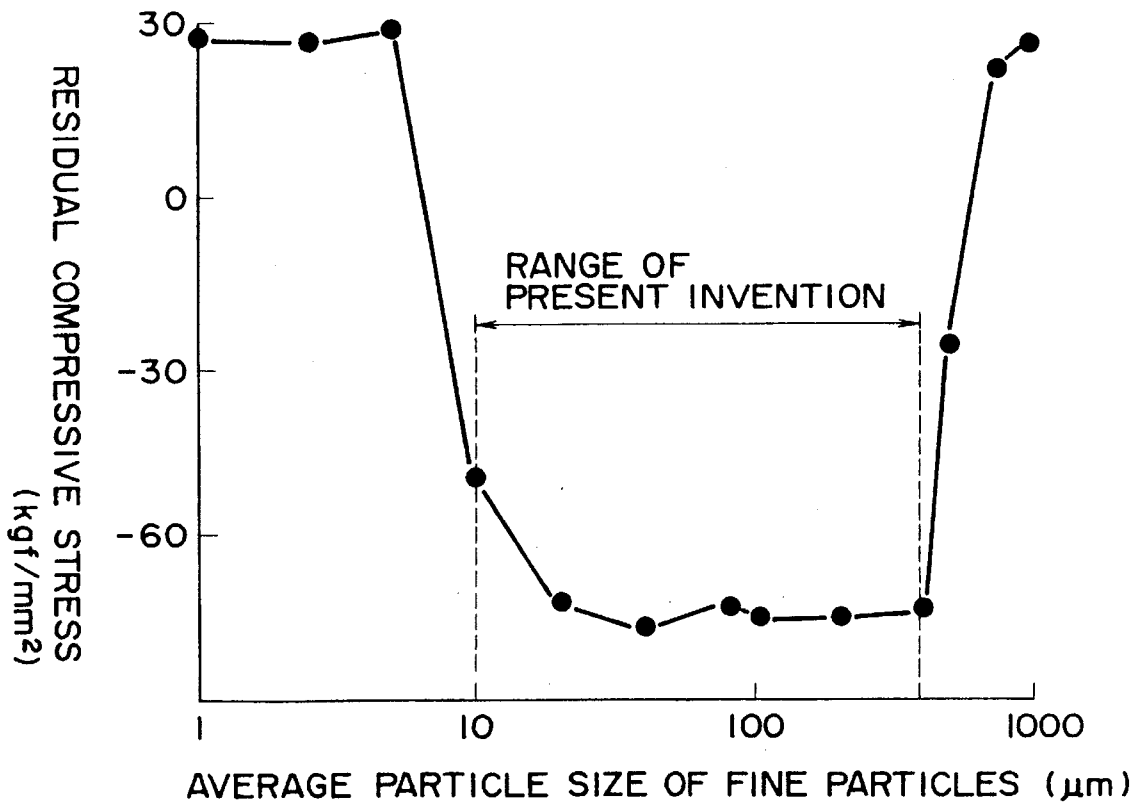
FIG. 4B is a graph showing the relationship between an average particle size of fine particles and a residual compressive stress upon honing treatment.

FIGS. 4A and 4B each show the relationship between the average particle size of fine particles and the depth of the residual compressive stress imparted to a plating layer (obtained by X-ray diffraction of the plating layer), with respect to the case that the surface of a Ni—P electroplating layer of a test piece after heat-treatment is subjected to honing treatment using spherical fine particles such as glass beads. As is apparent from these figures, when the average particle size is in the range of from 10 to 400 μm, the maximum residual compressive stress is imparted to the interior of the plating layer.

The reason for this is as follows: namely, when the average particle size is small, the collision energy is small, and thereby sufficient compressive stress is not applied; while when the particle size is excessively large, the collision energy is sufficiently increased but the number of the fine particles colliding with a unit area is reduced, and thereby sufficient compressive stress cannot be imparted, and further stress relief is generated by heat generation upon collision.

Figure 5A:
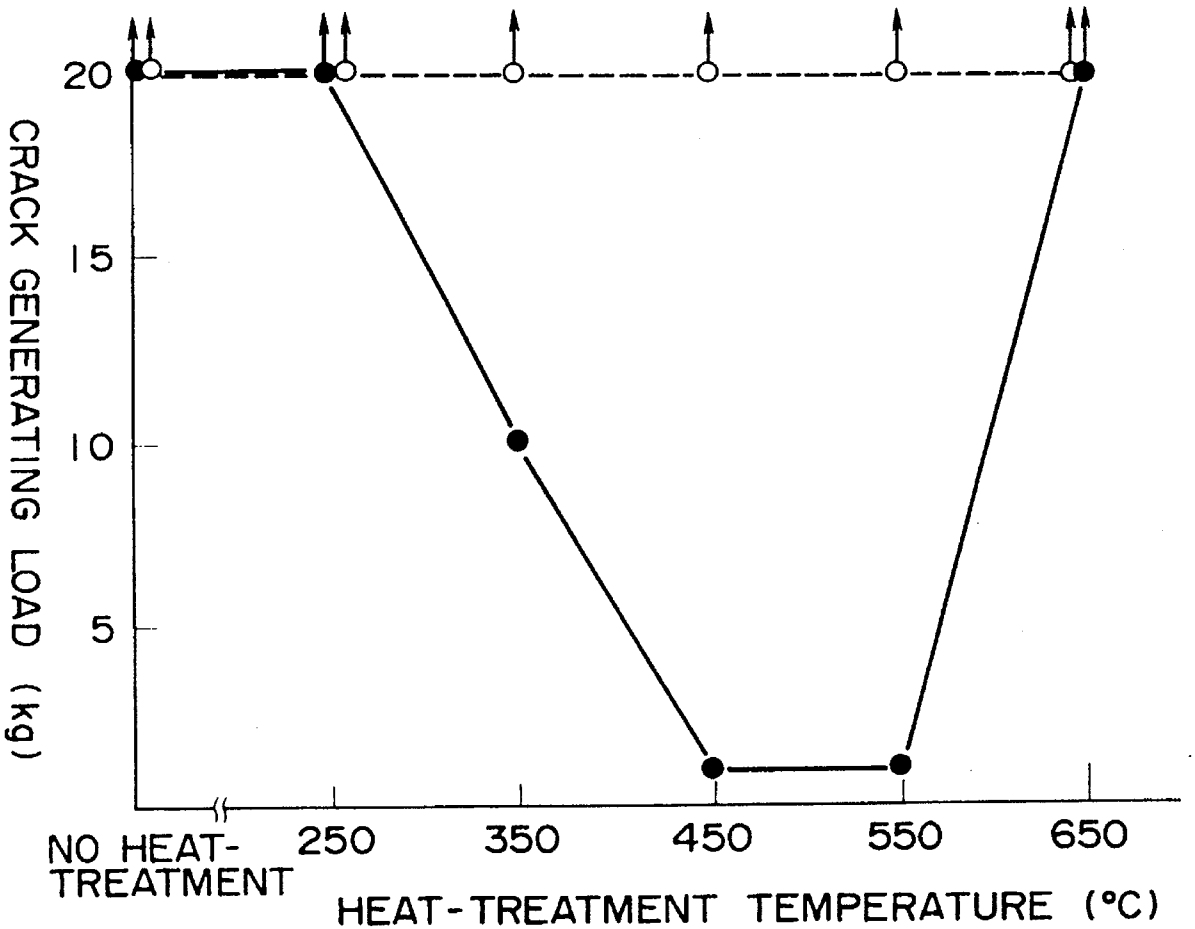
FIGS. 5A and 5B are graphs each showing the relationship between a heat treatment temperature and a crack generating load applied to a plating layer.
Figure 5B:
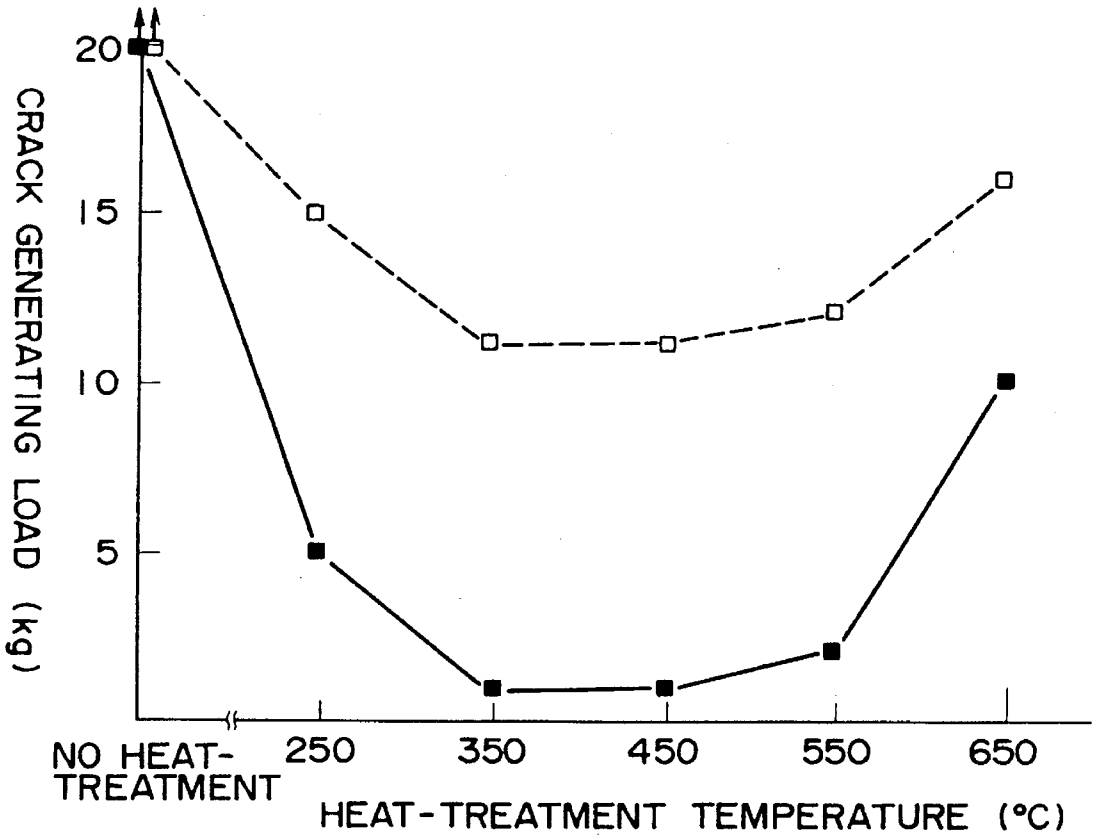

The present inventors have found the fact that the recovering degree of toughness by honing treatment performed after heat-treatment is dependent on the forming manner of a Ni—P plating layer, that is, on either electroless plating or electroplating. This will be described with reference to FIGS. 5A and 5B. FIGS. 5A and 5B show the crack generating load applied to the plating layer before and after honing treatment, with respect to a test piece in which the Ni—P electroless plating layer or Ni—P electroplating layer is subjected to vacuum heat-treatment and to honing treatment using glass beads having an average particle size of 200 μm. The test piece being high in the crack generating load is evaluated to be high in toughness. In addition, the crack generating load is measured using an apparatus modified from the normal Vickers hardness tester such that the load is changeable for each 1 kg. The crack generating load means a load causing the generation of cracks when the contact ball of this apparatus is pressed on the test piece.

As is apparent from FIGS. 5A and 5B, in the state being as heat-treated, toughness is significantly reduced in both the cases of Ni—P electroless plating and Ni—P electroplating. On the contrary, in the case of Ni—P electroless plating, the crack generating load is reduced by about ½ through honing treatment; while in the case of Ni—P electroplating, the crack generating load is little reduced through honing treatment. As a result, in the case of Ni—P electroplating, the toughness is easier to be recovered.

A surface treated Ti alloy member excellent in wear resistance can be thus obtained by applying Ni—P electroplating on the surface of a Ti alloy base member, followed by heat-treatment, and applying, on the surface of the Ti alloy base member, blasting of fine particles such as honing treatment using spherical fine particles having an average particle size of 10–400 μm.

Figure 6:
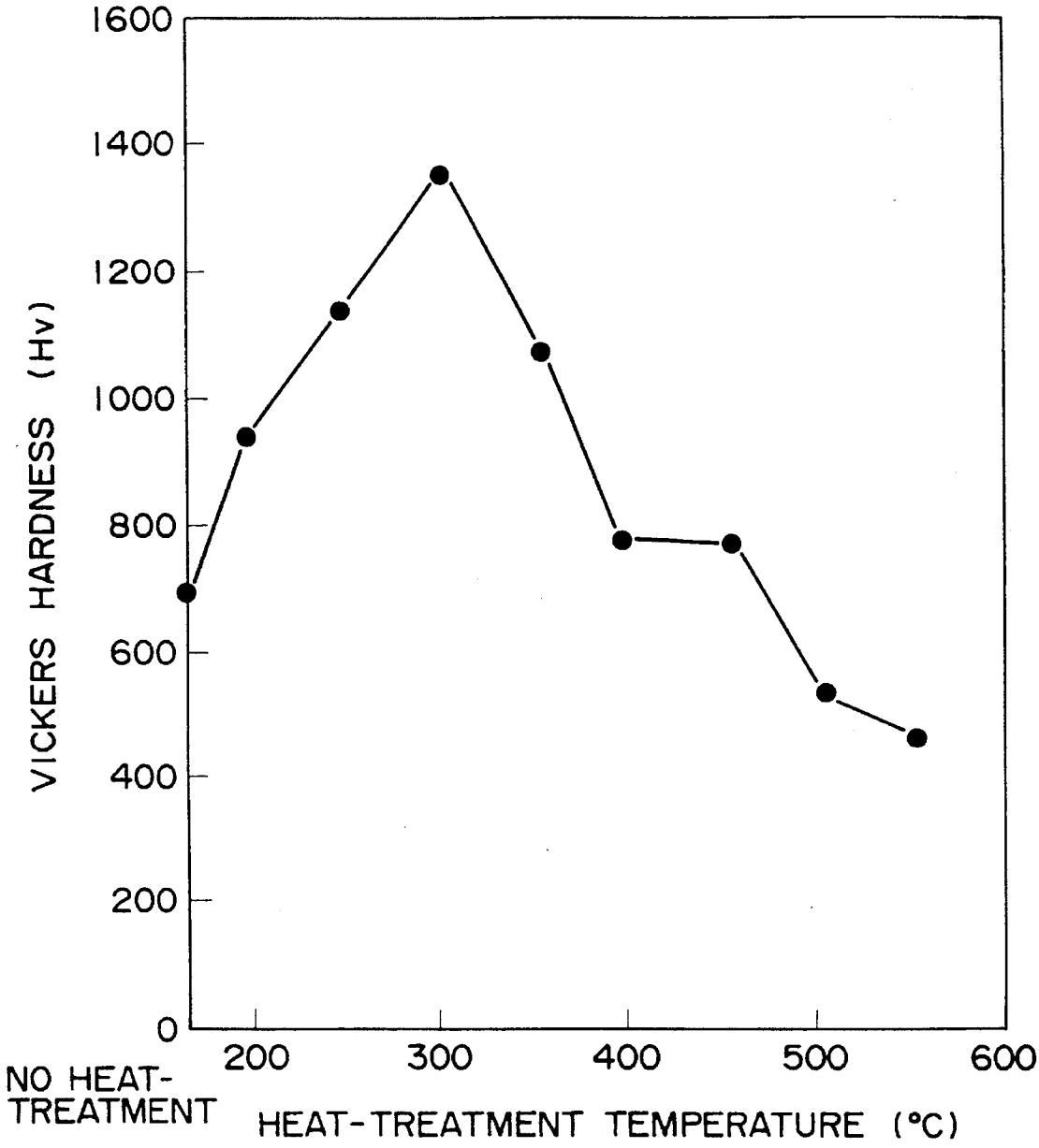
FIG. 6 is a graph showing the relationship between a heat treatment temperature and a Vickers hardness of a plating layer.

As described above, the techniques for applying heat-treatment on the Ni—P plating layer are disclosed in Unexamined Japanese Patent Publication Nos. HEI 2-221377, HEI 2-133578, SHO 63-312982, HEI 1-159358, HEI 5-78859, and HEI 4-246181. In these techniques, the heat-treatment temperature is generally in the range of from 200 to 500° C., and the heat-treatment time is generally in the range of 30 min to 2 hr. The present inventors have confirmed that, for heat-treatment of a Ni—P plating layer, as shown in FIG. 6, the hardness is maximized at about 300° C. and it is gradually lowered as the temperature is increased, and when the temperature is more than 500° C. the hardness is significantly softened relative to the value before heat-treatment.

On the other hand, by heat-treatment, a diffusion layer is formed at the interface between a plating layer and a base member and the adhesiveness of the plating layer is enhanced. Such an effect is increased nearly with the heat-treatment temperature. Accordingly, the preferred range of the heat-treatment condition of the prior arts seems to be determined to keep a relatively higher hardness of a plating layer and to keep a relatively higher adhesiveness. However, the preferred wear resistance improving effect cannot be obtained even by combination of the heat-treatment under such a condition and the conventional honing treatment.

The present inventors have found that, even for the above-described heat-treatment condition, by combination it with the subsequent honing treatment under a suitable condition, it becomes possible to further harden the plating layer and enhance the adhesiveness of the plating layer, and hence to achieve the excellent wear resistance. This is due to the effect of adopting the honing treatment using fine particles having the specified particle shape and the average particle size, in which the starting points of generation of cracks on the plating surface are suppressed. Accordingly, the present invention contains the case where the heat-treatment is performed under the known condition, specifically, for 30 min-2 hr at 100°–500° C., followed by the honing treatment under the above-described condition.

As described above, the preferred range of heat-treatment before honing treatment should be set to increase the hardness of a plating layer somewhat and to achieve the high adhesiveness thereof; however, in combination with the honing treatment performed under the specific condition, there is a possibility that the wear resistance can be further increased by further examining the above-described heat-treatment condition.

As a result, the present inventors have obtained a new knowledge that it is effective to enhance the adhesiveness of a plating layer even at the sacrifice of the hardness of the plating layer, that is, it is most effective to perform the heat-treatment for a short time at a temperature over 500° C. which has been avoided for preventing the softening of the plating layer in the prior art. Moreover, the hardness of the plating layer in the state being as heat-treated at a temperature over 500° C. is Hv 600 or less; however, it can be increased up to about Hv 100-150 by honing treatment under the above-described condition performed after heat-treatment, which is sufficient to be practically used as the wear resistant member. This is due to work hardening generated by collision of spherical particles with the plating layer. The effect cannot be obtained in the case of using non-spherical fine particles having sharp portions such as alumina or cut-wire shots.

Namely, when the heat-treatment temperature is increased up to 500° C. or more, a diffusion layer can be easily formed, to thus improve the adhesiveness. In this case, however, there is a fear that an embrittlement layer is formed at the interface between a plating layer and a base member. In the case where the embrittlement layer is formed, even when the thickness of the diffusion layer is increased, the diffusion layer is peeled by the presence of the embrittlement layer, thus failing to improve the wear resistance. A main embrittlement layer made of an intermetallic compound of Ti and Ni is formed at the interface between a Ti-alloy and Ni—P plating layer. To prevent the formation of such an embrittlement layer, it is desirable to suppress the heat-treatment temperature at about 650° C. or less. The reason why the heat-treatment time is specified at 1 hr or less is that even in the case of the heat-treatment temperature of 650° C. or less, when the heat-treatment time is made longer, there is a fear that an embrittlement layer is formed.

As described above, the heat-treatment condition of the present invention performed after formation of a Ni—P electroplating layer is in the range of from a relatively low temperature to a relatively high temperature. Specifically, the heat-treatment temperature is in the range of from 100° to 650° C., and the heat-treatment time is in the range of from 1 to 2 hr (longer on the lower temperature side, and shorter on the high temperature side). The heat-treatment is preferably performed for 0.1 to 1 hr at 500°–600° C.

The heat treatment condition thus specified in the above-described range is effective to enhance the adhesiveness of the plating layer at the sacrifice of the hardness of the plating layer and hence to improve the wear resistance. However, the adhesiveness can be further enhanced by performing the following pretreatment prior to formation of Ni—P plating layer. Namely, the pre-treatment is performed for accelerating the diffusion between a plating layer and a base member generated by the heat-treatment by a method of applying Ni based plating such as Ni—P plating or Ni plating on the surface of the base member prior to Ni—P electroplating, and applying honing treatment on the Ni based plating layer using non-spherical fine particles having sharp portions such as alumina or silicon carbide.

Figure 7A:
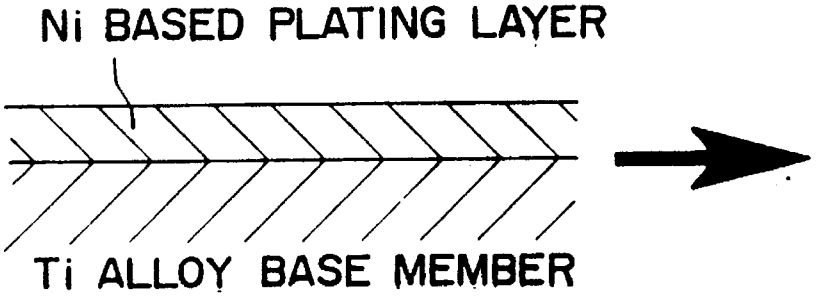
FIGS. 7*a* and 7 bare is a schematic view for illustrating the surface condition upon honing treatment using non-spherical fine particles after formation of a Ni based plating layer to a Ti alloy member.
Figure 7B:
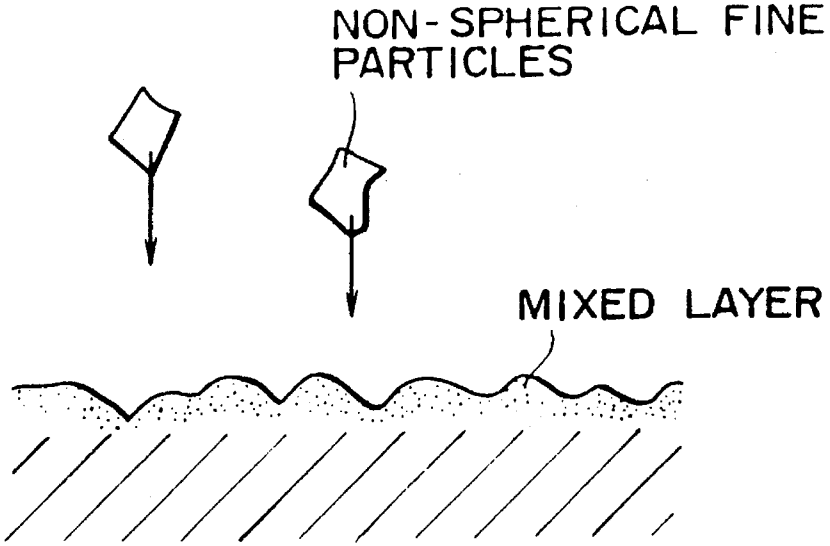

When a base member is subjected to Ni based plating such as Ni—P plating or Ni plating prior to Ni—P electroplating and the Ni plating layer is subjected to honing treatment using non-spherical fine particles having sharp portions such as alumina or silicon carbide, as shown in FIGS. 7*a* and 7*b*, a portion of the Ni based plating layer is removed by the grinding action of fine particles but the remaining portion of the layer is buried in the base member of the Ti-alloy base member, thus forming a mixed layer of Ti-alloy and Ni based plating material. Since the mixed layer is formed by deformation of the Ni based plating material and the Ti alloy base member, it has a strain energy higher than the non-deformation portion. Accordingly, by applying Ni—P electroplating on the surface of such a mixed layer and then applying heat-treatment thereto, the diffusion at the interface of the Ni—P electroplating layer is significantly improved by the strain energy of the mixed layer, thus significantly enhancing the adhesiveness between the base member and the plating layer.

The Ni based plating performed prior to Ni—P electroplating may be formed by either electroless plating or electroplating. In addition, when the thickness of the Ni based plating layer formed in this pre-treatment is insufficient, the amount of Ni component in the mixed layer becomes low, failing to obtain sufficient strain energy. On the contrary, when it is excessively thicker, the removed amount of the Ni based plating before formation of the mixed layer becomes larger. Accordingly, the thickness of the Ni based plating layer is preferably in the range of 0.5 to 5 μm.

As described above, by applying Ni based plating on the surface of a base member prior to formation of a Ni—P electroplating layer and applying honing treatment on the Ni based plating layer using non-spherical fine particles, it becomes possible to significantly accelerate the diffusion between the base member and the plating layer after Ni—P electroplating and heat-treatment and hence to enhance the wear resistance. In this specification, the treatment is referred to as "diffusion accelerating treatment".

In this way, one feature of the present invention lies in forming a diffusion layer between a plating layer and a base member for enhancing the adhesiveness of the plating layer, thereby improving the wear resistance. The effect is preferably achieved using a base material of a Ti alloy, which includes a (α+β) type titanium alloy such as Ti-6Al-4V, Ti-6Al-2Sn-4Zr-6Mo, or Ti-5Al-2Sn-2Zr-4Mo-4Cr; and a β type titanium alloy such as Ti-15Mo-5Zr-3Al, Ti-13V-11Cr-3Al, Ti-3Al-8V-6Cr-4Mo-4Zr (βc), or Ti-15V-3Cr-3Sn-3Al. In addition, FIG. 8 shows the thickness of a diffusion layer formed between a plating layer and a base member, which is examined by line analysis of Ti and Ni through AES (Auger Electron Spectroscopy), with respect to a Ti alloy base material subjected to Ni—P electroplating by a thickness of 30 μm and to vacuum heat-treatment for 30 min at 550° C.

Figure 8:
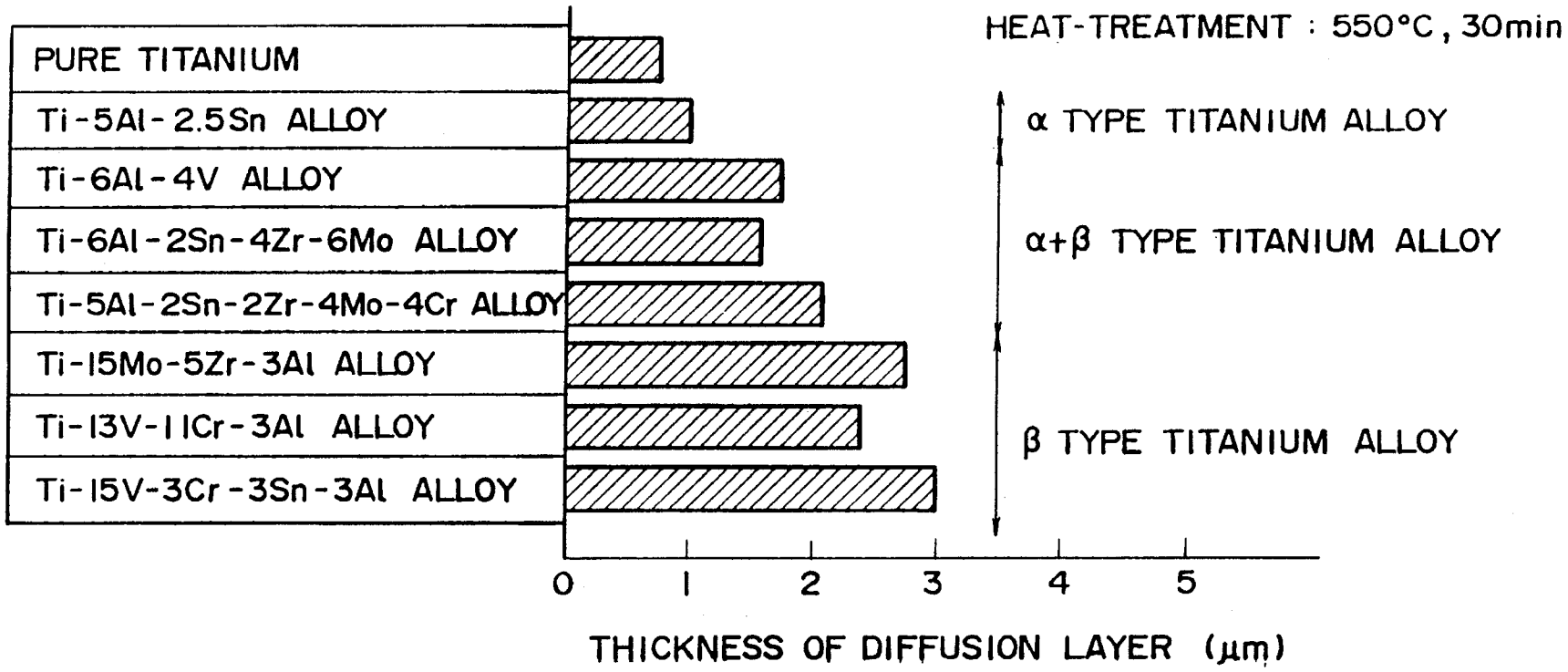
FIG. 8 is a graph showing the thickness of a diffusion layer formed upon post-heat treatment after applying Ni—P electroplating on a Ti alloy member.

As is apparent from FIG. 8, in the case of using a (α+β) type titanium alloy as a base material, the thickness of a diffusion layer is about 1.5–2.5 times that of the case of using pure titanium or α type titanium alloy. The reason for this is that Ni is easier to be diffused in the base material of the (α+β) or β type titanium alloy including a β layer of the bcc structure (not close-packed structure), as compared with the case of pure titanium or the α type titanium alloy having the hcp structure (close-packed structure). Moreover, it is also considered that a large amount of additional elements exert an effect on the formation of the diffusion layer.

Figure 9:
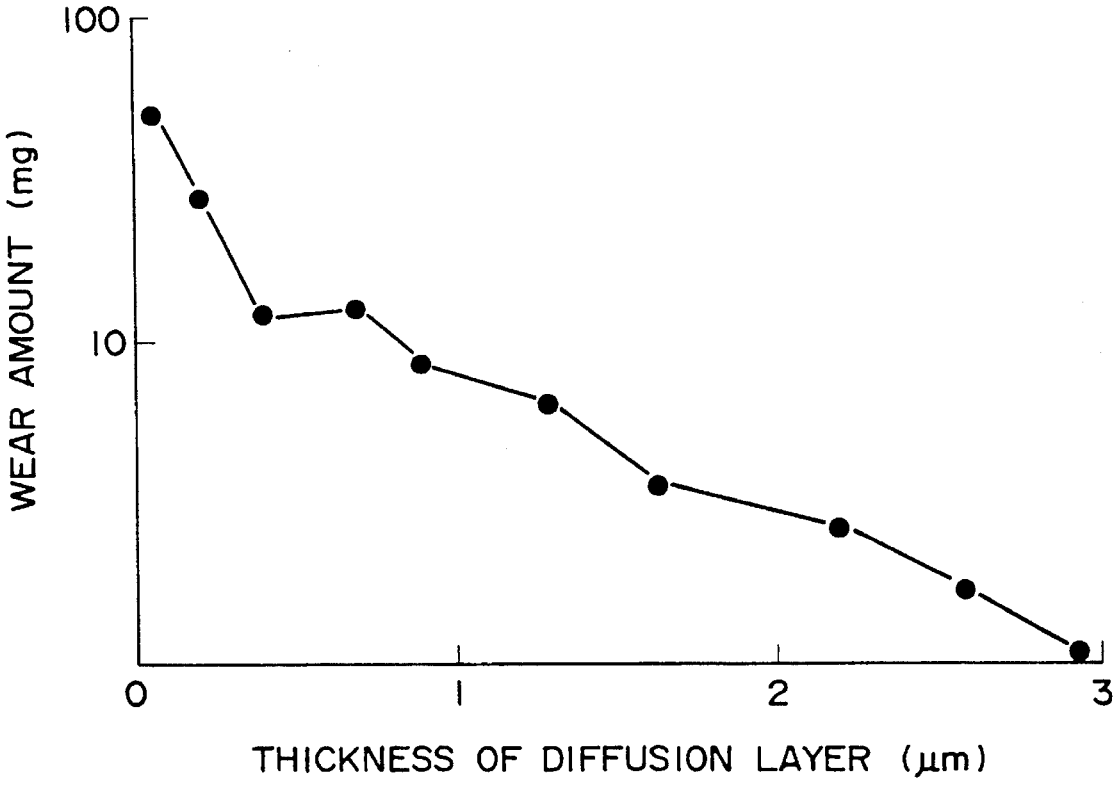
FIG. 9 is a graph showing the relationship between a thickness of a diffusion layer and a wear amount.

FIG. 9 is a graph showing the relationship between the thickness of a diffusion layer and the wear resistance. From this graph, as the thickness of the diffusion layer is increased, the adhesiveness of the diffusion layer is enhanced, and thereby the wear resistance is improved.

In the foregoing, the description has been made with respect to the case of using a titanium alloy as a base material; however, the formation of a diffusion layer between the plating layer and the base material is recognized even in the case of using an iron based alloy, nickel based alloy or Al based alloy as the base material. In the case of using an iron based alloy or nickel based alloy as the base material, a diffusion layer similar to that in the case of a titanium alloy is formed between the plating layer and the base member under a heat-treatment condition similar to that in the case of the titanium alloy, thus enhancing the adhesiveness. In this case, by setting the heat-treatment condition such that the heat treatment temperature is in the range of 500°–600° C. and the heat treatment time is in the range of 0.1–1 hr, it becomes possible to more easily form the diffusion layer, and to eliminate a fear in formation of an embrittlement layer at the interface.

Moreover, it becomes apparent that when a base member is subjected to Ni—P or Ni based plating to a thickness of 0.5–5 μm prior to Ni–P electroplating and the surface of the plating layer is subjected to blasting of fine particles such as honing treatment using non-spherical fine particles such as alumina, a mixed layer is formed between the plating layer and the base member, and thereby the formation of the diffusion layer is easily accelerated by the subsequent heat-treatment. On the other hand, the blasting of spherical fine particles after plating is performed to reform the plating layer itself, and accordingly, even in the case of a base material of an iron based alloy, the same condition may be adopted. In addition, the specific examples of iron based alloys include common steel, Cr steel, Ni—Cr steel and Ni—Cr—Mo steel.

Since the blasting of spherical fine particles after plating is performed to reform the plating itself, even in the case of using an Al alloy as a base material, the same effect as that in the case of using a titanium alloy or iron based alloy can be obtained. However, since the melting point of an Al alloy is low, the heat-treatment temperature is limited to about 400°–500° C., and consequently the thickness of the diffusion layer is not larger as compared with the case of using a titanium alloy or iron based alloy; however, the adhesiveness is increased somewhat by formation of the diffusion layer. Moreover, the effect of suppressing the starting points of generation of cracks due to the honing treatment as described above can be effectively achieved, thus enhancing the wear resistance.

The effect of the heat-treatment of the base material made of an Al alloy mainly lies in the improvement of the hardness of plating layer as shown in FIG. 6, when compared with a titanium alloy. At all events, the base material of an Al alloy can be significantly improved in wear resistance as compared with the conventional manner, by hardening the plating layer due to the diffusion through heat-treatment, blasting spherical fine particles, and by applying diffusion accelerating treatment. Namely, even for the base material of an Al alloy, by applying Ni based plating such as Ni—P plating or Ni plating to a thickness of 0.5–5 μm before Ni—P electroplating, and then blasting non-spherical fine particles such as alumina, the wear resistance is significantly improved by the acceleration of diffusion between a plating layer and the base member and the hardening of the plating layer. In addition, preferably, an Al alloy is subjected to aging treatment in accordance with the kind thereof after heat-treatment for increasing the strength by age-hardening.

The present invention will be more clearly understood with reference to the following examples. In addition, the following examples are only illustrative and not restrictive, and it is to be understood that various changes and modifications may be made without departing from the spirit and scope of the present invention.

EXAMPLE 1

Figure 10:
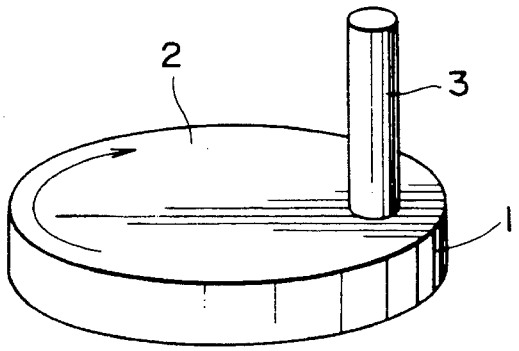
FIG. 10 is a schematic view for illustrating a method of testing wear resistance used in embodiments of the present invention.

A commercial round bar of Ti-6Al-4V alloy was machined in a test piece 1 having a shape shown in FIG. 10, and was subjected to surface roughening treatment by degreasing and acid picking. Subsequently, a surface 2 to be evaluated, of the test piece 1 shown in FIG. 10 was subjected to each of Ni—P electroplating and Ni—P electroless plating. The test piece was subjected to heat-treatment in a specified condition and to dry honing treatment in a specified condition, and then evaluated in terms of wear resistance.

The wear resistance was evaluated in a procedure shown in FIG. 10. A pin 3 (diameter: 5 mm) formed of a soft-nitrided SCM435 bar (Vickers hardness: about Hv 750) commonly used as a wear resisting member was pressed on the test piece 1 at a load of 20 kgf. In this state, the contact portion between the pin and the test piece was rotated at a speed of 2 m/sec by rotation of the desk (the test piece). The wear resistance was evaluated on the basis of the wear amount of the test piece after running of the test piece by a wear distance of 1000 m. The test was carried out in a non-lubricant state.

The measured results are shown in Tables 1 to 7. Here, the wear resistance was comparatively evaluated, in which a difference between the maximum wear amount and the minimum wear amount of the test pieces was divided into six equal divisions, and the wear resistance of each test piece was ranked in order of wear amount (6: very excellent, 5: excellent, 4: slightly excellent, 3: slightly poor, 2: poor, 1: very poor). In Sample Nos. 1 to 81 of Tables 1 to 4, the honing treatment was carried out using only glass beads as fine particles; however, the same effect of the honing treatment can be obtained even in the case of using different fine particles having spherical shapes similar to those of glass beads. For example, spherical fine particles of zircon can be used, with the same effect.

TABLE 1

| | | Plating | | Heat treatment | | Honing treatment | | | |
|---|---|---|---|---|---|---|---|---|---|
| No. | Base material | Method | Film thickness μm | Temperature, °C. | Time, h | Fine particles | Average particle size, μm | Wear resistance | Remarks |
| 1 | Ti-6Al-4V | Ni—P electroplating | 30 | 80 | 0.5 | Glass beads | 10 | 4 | Inventive Example |
| 2 | " | Ni—P electroplating | " | " | " | " | 200 | 4 | Inventive Example |
| 3 | " | Ni—P electroplating | " | " | " | " | 400 | 4 | Inventive Example |
| 4 | " | Ni—P electroplating | " | " | 1 | " | 10 | 4 | Inventive Example |
| 5 | " | Ni—P electroplating | " | " | " | " | 200 | 4 | Inventive Example |
| 6 | " | Ni—P electroplating | " | " | " | " | 400 | 4 | Inventive Example |
| 7 | " | Ni—P electroplating | " | " | 2 | " | 10 | 4 | Inventive Example |
| 8 | " | NI—P electroplating | " | " | " | " | 200 | 4 | Inventive Example |
| 9 | " | N—P | " | " | " | " | 400 | 4 | Inventive |

TABLE 1-continued

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| | | electro-plating | | | | | | | Example |
| 10 | " | N—P electro-plating | " | 110 | 0.5 | " | 10 | 4 | Inventive Example |
| 11 | " | Ni—P electro-plating | " | " | " | " | 200 | 4 | Inventive Example |
| 12 | " | Ni—P electro-plating | " | " | " | " | 400 | 5 | Inventive Example |
| 13 | " | Ni—P electro-plating | " | " | 1 | " | 10 | 4 | Inventive Example |
| 14 | " | Ni—P electro-plating | " | " | " | " | 200 | 5 | Inventive Example |
| 15 | " | Ni—P electro-plating | " | " | " | " | 400 | 5 | Inventive Example |
| 16 | " | Ni—P electro-plating | " | " | 2 | " | 10 | 4 | Inventive Example |
| 17 | " | Ni—P electro-plating | " | " | " | " | 200 | 5 | Inventive Example |
| 18 | " | Ni—P electro-plating | " | " | " | " | 400 | 5 | Inventive Example |

TABLE 2

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 19 | Ti-6Al-4V | Ni—P electro-plating | 30 | 300 | 0.5 | Glass beads | 10 | 4 | Inventive Example |
| 20 | " | Ni—P electro-plating | " | " | " | " | 200 | 4 | Inventive Example |
| 21 | " | Ni—P electro-plating | " | " | " | " | 400 | 4 | Inventive Example |
| 22 | " | Ni—P electro-plating | " | " | 1 | " | 10 | 5 | Inventive Example |
| 23 | " | Ni—P electro-plating | " | " | " | " | 200 | 5 | Inventive Example |
| 24 | " | Ni—P electro-plating | " | " | " | " | 400 | 4 | Inventive Example |
| 25 | " | Ni—P electro-plating | " | " | 2 | " | 10 | 4 | Inventive Example |
| 26 | " | NI—P electro-plating | " | " | " | " | 200 | 4 | Inventive Example |
| 27 | " | N—P electro-plating | " | " | " | " | 400 | 4 | Inventive Example |
| 28 | " | N—P electro-plating | " | 450 | 0.5 | " | 10 | 4 | Inventive Example |
| 29 | " | Ni—P electro-plating | " | " | " | " | 200 | 5 | Inventive Example |

TABLE 2-continued

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 30 | " | Ni—P electro-plating | " | " | " | " | 400 | 5 | Inventive Example |
| 31 | " | Ni—P electro-plating | " | " | 1 | " | 10 | 5 | Inventive Example |
| 32 | " | Ni—P electro-plating | " | " | " | " | 200 | 5 | Inventive Example |
| 33 | " | Ni—P electro-plating | " | " | " | " | 400 | 5 | Inventive Example |
| 34 | " | Ni—P electro-plating | " | " | 2 | " | 10 | 5 | Inventive Example |
| 35 | " | Ni—P electro-plating | " | " | " | " | 200 | 4 | Inventive Example |
| 36 | " | Ni—P electro-plating | " | " | " | " | 400 | 4 | Inventive Example |
| 37 | " | Ni—P electro-plating | " | 500 | 1 | Glass beads | 10 | 5 | Inventive Example |
| 38 | " | Ni—P electro-plating | " | " | " | " | 200 | 5 | Inventive Example |
| 39 | " | Ni—P electro-plating | " | " | " | " | 400 | 5 | Inventive Example |
| 40 | " | Ni—P electro-plating | " | " | 0.5 | " | 10 | 5 | Inventive Example |
| 41 | " | Ni—P electro-plating | " | " | " | " | 200 | 6 | Inventive Example |
| 42 | " | Ni—P electro-plating | " | " | " | " | 400 | 6 | Inventive Example |
| 43 | " | Ni—P electro-plating | " | " | 0.2 | " | 10 | 6 | Inventive Example |
| 44 | " | NI—P electro-plating | " | " | " | " | 200 | 6 | Inventive Example |
| 45 | " | N—P electro-plating | " | " | " | " | 400 | 6 | Inventive Example |

TABLE 3

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 46 | Ti-6Al-4V | Ni—P electro-plating | 30 | 550 | 1 | Glass beads | 10 | 5 | Inventive Example |
| 47 | " | Ni—P electro-plating | " | " | " | " | 200 | 5 | Inventive Example |
| 48 | " | Ni—P electro-plating | " | " | " | " | 400 | 4 | Inventive Example |
| 49 | " | Ni—P electro-plating | " | " | 0.5 | " | 10 | 6 | Inventive Example |
| 50 | " | Ni—P electro- | " | " | " | " | 200 | 6 | Inventive Example |

TABLE 3-continued

| No. | Base material | Plating Method | Plating Film thickness μm | Heat treatment Temperature, °C. | Heat treatment Time, h | Honing treatment Fine particles | Honing treatment Average particle size, μm | Wear resistance | Remarks |
|---|---|---|---|---|---|---|---|---|---|
| | | plating | | | | | | | |
| 51 | " | Ni—P electro-plating | " | " | " | " | 400 | 6 | Inventive Example |
| 52 | " | Ni—P electro-plating | " | " | 0.2 | " | 10 | 6 | Inventive Example |
| 53 | " | NI—P electro-plating | " | " | " | " | 200 | 6 | Inventive Example |
| 54 | " | N—P electro-plating | " | " | " | " | 400 | 6 | Inventive Example |
| 55 | " | N—P electro-plating | " | 600 | 1 | " | 10 | 5 | Inventive Example |
| 56 | " | Ni—P electro-plating | " | " | " | " | 200 | 5 | Inventive Example |
| 57 | " | Ni—P electro-plating | " | " | " | " | 400 | 5 | Inventive Example |
| 58 | " | Ni—P electro-plating | " | " | 0.5 | " | 10 | 6 | Inventive Example |
| 59 | " | Ni—P electro-plating | " | " | " | " | 200 | 6 | Inventive Example |
| 60 | " | Ni—P electro-plating | " | " | " | " | 400 | 6 | Inventive Example |
| 61 | " | Ni—P electro-plating | " | " | 0.2 | " | 10 | 5 | Inventive Example |
| 62 | " | Ni—P electro-plating | " | " | " | " | 200 | 5 | Inventive Example |
| 63 | " | Ni—P electro-plating | " | " | " | " | 400 | 4 | Inventive Example |

TABLE 4

| No. | Base material | Plating Method | Plating Film thickness μm | Heat treatment Temperature, °C. | Heat treatment Time, h | Honing treatment Fine particles | Honing treatment Average particle size, μm | Wear resistance | Remarks |
|---|---|---|---|---|---|---|---|---|---|
| 64 | Ti-6Al-4V | Ni—P electro-plating | 100 | 450 | 0.5 | Glass beads | 10 | 4 | Inventive Example |
| 65 | " | Ni—P electro-plating | " | " | " | " | 200 | 5 | Inventive Example |
| 66 | " | Ni—P electro-plating | " | " | " | " | 400 | 5 | Inventive Example |
| 67 | " | Ni—P electro-plating | " | " | 1 | " | 10 | 4 | Inventive Example |
| 68 | " | Ni—P electro-plating | " | " | " | " | 200 | 5 | Inventive Example |
| 69 | " | Ni—P electro-plating | " | " | " | " | 400 | 4 | Inventive Example |
| 70 | " | Ni—P electro-plating | " | " | 2 | " | 10 | 5 | Inventive Example |
| 71 | " | NI—P | " | " | " | " | 200 | 4 | Inventive |

TABLE 4-continued

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| | | electroplating | | | | | | | Example |
| 72 | " | N—P electroplating | " | " | " | " | 400 | 4 | Inventive Example |
| 73 | " | N—P electroplating | " | 550 | 1 | " | 10 | 5 | Inventive Example |
| 74 | " | Ni—P electroplating | " | " | " | " | 200 | 5 | Inventive Example |
| 75 | " | Ni—P electroplating | " | " | " | " | 400 | 4 | Inventive Example |
| 76 | " | Ni—P electroplating | " | " | 0.5 | " | 10 | 6 | Inventive Example |
| 77 | " | Ni—P electroplating | " | " | " | " | 200 | 6 | Inventive Example |
| 78 | " | Ni—P electroplating | " | " | " | " | 400 | 5 | Inventive Example |
| 79 | " | Ni—P electroplating | " | " | 0.2 | " | 10 | 5 | Inventive Example |
| 80 | " | Ni—P electroplating | " | " | " | " | 200 | 5 | Inventive Example |
| 81 | " | Ni—P electroplating | " | " | " | " | 400 | 5 | Inventive Example |

TABLE 5

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 82 | Ti-6Al-4V | Ni—P electroplating | 30 | — | — | — | — | 1 | Comparative Example |
| 83 | " | Ni—P electroplating | " | 550 | 0.5 | " | " | 2 | Comparative Example |
| 84 | " | Ni—P electroplating | " | 450 | 1 | Glass beads | 5 | 3 | Comparative Example |
| 85 | " | Ni—P electroplating | " | " | " | " | 10 | 4 | Comparative Example |
| 86 | " | Ni—P electroplating | " | " | " | Alumina | 10 | 2 | Comparative Example |
| 87 | " | Ni—P electroplating | " | " | " | " | 200 | 1 | Comparative Example |
| 88 | " | Ni—P electroplating | " | " | 2 | " | 400 | 1 | Comparative Example |
| 89 | " | NI—P electroplating | " | " | " | silicon carbide | 10 | 1 | Comparative Example |
| 90 | " | N—P electroplating | " | " | " | " | 200 | 2 | Comparative Example |
| 91 | " | N—P electroplating | " | " | " | " | 400 | 1 | Comparative Example |
| 92 | " | Ni—P electroplating | " | " | " | Cut-wire shot | 200 | 1 | Comparative Example |
| 93 | " | Ni—P electroplating | " | 500 | 2 | Glass beads | 50 | 1 | Reference Example |
| 94 | " | Ni—P electroplating | " | " | 1 | " | 200 | 1 | Reference Example |
| 95 | " | Ni—P electroplating | " | " | " | " | 400 | 1 | Reference Example |
| 96 | " | Ni—P electroplating | " | " | 0.5 | " | 5 | 1 | Comparative Example |

TABLE 5-continued

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 97 | " | Ni—P electroplating | " | " | 2 | " | 500 | 1 | Comparative Example |
| 98 | " | Ni—P electroplating | " | " | " | Alumina | 10 | 1 | Comparative Example |
| 99 | " | Ni—P electroplating | " | " | " | " | 200 | 1 | Comparative Example |
| 100 | " | Ni—P electroplating | " | " | " | " | 400 | 1 | Comparative Example |
| 101 | " | Ni—P electroplating | " | " | " | silicon carbide | 10 | 2 | Comparative Example |
| 102 | " | Ni—P electroplating | " | " | " | " | 200 | 1 | Comparative Example |
| 103 | " | Ni—P electroplating | " | " | " | " | 400 | 2 | Comparative Example |
| 104 | " | Ni—P electroplating | " | " | " | Cut-wire shot | 200 | 1 | Comparative Example |

TABLE 6

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 105 | Ti-6Al-4V | Ni—P electroplating | 30 | 550 | 2 | Glass beads | 50 | 1 | Comparative Example |
| 106 | " | Ni—P electroplating | " | " | " | " | 200 | 2 | Comparative Example |
| 107 | " | Ni—P electroplating | " | " | " | " | 400 | 1 | Comparative Example |
| 108 | " | Ni—P electroplating | " | " | 0.5 | " | 5 | 1 | Comparative Example |
| 109 | " | Ni—P electroplating | " | " | " | " | 500 | 1 | Comparative Example |
| 110 | " | Ni—P electroplating | " | " | " | Alumina | 10 | 1 | Comparative Example |
| 111 | " | Ni—P electroplating | " | " | " | " | 200 | 2 | Comparative Example |
| 112 | " | NI—P electroplating | " | " | " | " | 400 | 1 | Comparative Example |
| 113 | " | N—P electroplating | " | " | " | Silicone carbon | 10 | 1 | Comparative Example |
| 114 | " | N—P electroplating | " | " | " | " | 200 | 2 | Comparative Example |
| 115 | " | Ni—P electroplating | " | " | " | " | 400 | 2 | Comparative Example |
| 116 | " | Ni—P electroplating | " | " | " | Cut-wire shop | 200 | 2 | Comparative Example |
| 117 | " | Ni—P electroplating | " | 650 | 1 | Glass beads | 10 | 2 | Comparative Example |
| 118 | " | Ni—P electroplating | " | " | " | " | 200 | 2 | Comparative Example |
| 119 | " | Ni—P electroplating | " | " | " | " | 400 | 1 | Comparative Example |
| 120 | " | Ni—P electroplating | " | " | 0.5 | " | 10 | 2 | Comparative Example |
| 121 | " | Ni—P electroplating | " | " | " | " | 200 | 2 | Comparative Example |
| 122 | " | Ni—P electroplating | " | " | " | " | 400 | 2 | Comparative Example |
| 123 | " | Ni—P electroplating | " | " | 0.2 | " | 10 | 3 | Comparative Example |
| 124 | " | Ni—P electroplating | " | " | " | " | 200 | 3 | Comparative Example |
| 125 | " | Ni—P electroplating | " | " | " | " | 400 | 2 | Comparative Example |

TABLE 7

| No. | Base material | Plating: Method | Plating: Film thickness μm | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 126 | Ti-6Al-4V | Ni—P electroless plating | 30 | 450 | 1 | Glass beads | 10 | 3 | Comparative Example |
| 127 | " | Ni—P electroless plating | " | " | " | " | 200 | 3 | Comparative Example |
| 128 | " | Ni—P electroless plating | " | " | " | " | 400 | 2 | Comparative Example |
| 129 | " | Ni—P electroless plating | " | " | " | " | 10 | 3 | Comparative Example |
| 130 | " | Ni—P electroless plating | " | " | " | " | 200 | 2 | Comparative Example |
| 131 | " | Ni—P electroless plating | " | " | " | " | 400 | 2 | Comparative Example |
| 132 | " | Ni—P electroless plating | " | " | 0.5 | " | 10 | 3 | Comparative Example |
| 133 | " | NI—P less plating | " | " | " | " | 400 | 3 | Comparative Example |
| 134 | " | N—P less plating | " | " | 0.2 | " | 10 | 3 | Comparative Example |
| 135 | " | N—P less plating | " | " | " | " | 200 | 3 | Comparative Example |
| 136 | " | Ni—P electroless plating | " | " | " | " | 400 | 3 | Comparative Example |

As is apparent from Tables 1 to 7, Sample Nos. 1 to 81 (inventive example), which satisfy the requirements of the present invention, exhibit the wear resistances superior to those of Sample Nos. 82 to 136 (comparative example). In particular, Sample Nos. 37 to 63, and 73 to 81 (inventive example), in which heat treatments are performed for 0.1–1 hr at 500°–600° C., exhibit very excellent wear resistances. The reason for this is that a diffusion layer is formed without formation of an embrittlement layer between a plating layer and a base member by the heat-treatment performed for a relatively short time at a high temperature, and thereby the adhesiveness of the plating layer with the base member is significantly enhanced. On the contrary, in Sample Nos. 93 to 95, 105, 107 (comparative example), since the heat-treatments are performed for 2 hr at temperatures of 500° C. or more, an embrittlement layer is formed at an interface between a plating layer and a base member and thereby the wear resistances thereof become relatively poor.

Sample Nos. 10–36 (inventive example) are the cases where the heat-treatment temperatures are set at slightly lower values of 100°–450° C. These samples are inferior in wear resistance to Sample Nos. 93 to 95 and 105 to 107 (inventive example) in which the heat-treatment temperatures are set at preferable values of 500°–600° C. (Sample Nos. 10–36 partially exhibit similar wear resistances but are evaluated to be slightly poor in total), but they are superior in wear resistance to Sample Nos. 1 to 9 (inventive example) in which the heat-treatment temperature is as very low as less than 100° C. As is apparent from these samples, even when the heat-treatment temperature is low, a relatively higher hardness is imparted to a plating layer and the adhesiveness is enhanced.

On the other hand, Sample Nos. 86 to 92, 98 to 104, and 110 to 116 (comparative example) are the cases in which spherical fine particles are not used. In these samples, the toughness of a plating layer reduced by heat-treatment is not recovered by the subsequent honing treatment, and further since non-spherical fine particles having sharp portions are used, the starting points of generation of cracks are formed in the plating layer, and thereby the wear resistance is deteriorated. In Sample Nos. 117 to 125 (comparative example), glass beads having an average particle size of 10–400 μm are used as fine particles for honing treatment but the heat-treatment temperature is as high as 650° C., so that an embrittlement layer is formed at the interface between the plating layer and the base member, failing to obtain the sufficient wear resistance. In Sample Nos. 84, 85, 108 and 109 (comparative example), since glass beads are used but the particle size thereof is out of the specified range of 10–400 μm, the wear resistance is also poor. Sample Nos. 126 to 136 (comparative example) are the cases where Ni—P electroless plating is carried out. In these samples, the toughness of the plating layer reduced by the heat-treatment is not sufficiently recovered by the subsequent honing treatment, failing to obtain the sufficient wear resistance.

EXAMPLE 2

A commercial round bar of Ti-6Al-4V alloy was machined in a test piece 1 having a shape shown in FIG. 10, and was subjected to surface roughening treatment by degreasing and acid picking. Subsequently, the test piece was subjected to the following treatments, and was evaluated in terms of wear resistance. The evaluation of wear resistance was performed in the same manner as in Example 1.

(Test Piece Preparing Process)

(1) Ni—P electroplating (applied to a surface 2 to be evaluated by film thickness: 0.1–5 μm) ↓

(2) honing treatment using alumina or glass beads applied to plating layer ↓

(3) acid pickling ↓

(4) Ni-P electroplating (film thickness: 30 μm) ↓

(5) heat-treatment under various conditions ↓

(6) honing treatment using glass beads (average particle size: 200 μm)

The evaluated results of wear resistance are shown in Tables 8 and 9. Here, the wear resistance is comparatively evaluated. The ranking is the same as that in Example 1.

In Sample Nos. 137 to 152 of Table 8, only alumina powder are used as fine particles for diffusion accelerating treatment. However, the same effect can be obtained even in the case of using different fine particles of non-spherical shapes having sharp portions like alumina. For example, non-spherical fine particles of silicon carbide can be used, with the same effect.

TABLE 8

| | | Diffusion accelerating treatment | | Heat treatmenta | | Honing treatment | | | |
|---|---|---|---|---|---|---|---|---|---|
| No. | Base material | Plating thickness, μm | Fine particles for honing treatment | Temperature, °C | Time, h | Fine particles | Average particle size, μm | Wear resistance | Remarks |
| 137 | Ti-6Al-4V | 0.5 | Alumina (200*) | 300 | 1 | Glass beads | 200 | 4 | Inventive Example |
| 138 | " | " | Alumina (200*) | 450 | 1 | " | " | 5 | Inventive Example |
| 139 | " | " | Alumina (200*) | 500 | 1 | " | " | 5 | Inventive Example |
| 140 | " | 1 | Alumina (200*) | " | 0.5 | " | " | 6 | Inventive Example |
| 141 | ""Alumina | " | 0.2 (200*) | " | " | " | 6 | Inventive | Example |
| 142 | " | " | Alumina (200*) | 500 | 1 | " | " | 5 | Inventive Example |
| 143 | " | " | Alumina (200*) | " | 0.5 | " | " | 6 | Inventive Example |
| 144 | " | " | Alumina (200*) | " | 0.2 | " | " | 6 | Inventive Example |
| 145 | " | 5 | Alumina (200) | 300 | 1 | "" | 4 | Inventive | Example |
| 146 | " | " | Alumina (200) | 450 | 1 | " | " | 5 | Inventive Example |
| 147 | " | " | Alumina (200) | 550 | 1 | " | " | 5 | Inventive Example |
| 148 | " | " | Alumina (200) | " | 0.5 | " | " | 6 | Inventive Example |
| 149 | " | " | Alumina (200) | " | 0.2 | " | " | 6 | Inventive Example |
| 150 | " | 1 | Alumina (200) | " | 1 | " | " | 5 | Inventive Example |
| 151 | " | " | Alumina (200) | " | 0.5 | " | " | 6 | Inventive Example |
| 152 | " | " | Alumina (200) | " | 0.2 | " | " | 6 | Inventive Example |

TABLE 9

| | | Diffusion accelerating treatment | | Heat treatmenta | | Honing treatment | | | |
|---|---|---|---|---|---|---|---|---|---|
| No. | Base material | Plating thickness, μm | Fine particles for honing treatment | Temperature, °C | Time, h | Fine particles | Average particle size, μm | Wear resistance | Remarks |
| 153 | Ti-6Al-4V | — | — | 450 | 1 | Glass beads | 200 | 1 | Reference Example |
| 154 | " | " | " | 550 | 1 | " | " | 2 | Reference Example |
| 155 | " | " | " | " | 0.5 | " | " | 3 | Reference Example |
| 156 | " | " | " | " | 0.2 | " | " | 3 | Reference Example |
| 157 | " | " | Alumina (200) | 450 | 1 | " | " | 2 | Reference Example |
| 158 | " | " | Alumina (200) | 550 | 1 | " | " | 3 | Reference Example |

TABLE 9-continued

| No. | Base material | Diffusion accelerating treatment: Plating thickness, μm | Diffusion accelerating treatment: Fine particles for honing treatment | Heat treatmenta: Temperature, °C | Heat treatmenta: Time, h | Honing treatment: Fine particles | Honing treatment: Average particle size, μm | Wear resistance | Remarks |
|---|---|---|---|---|---|---|---|---|---|
| 159 | " | " | Alumina (200) | " | 0.5 | " | " | 3 | Reference Example |
| 160 | " | " | Alumina (200) | " | 0.2 | " | " | 3 | Reference Example |
| 161 | " | 1 | Glass beads (200) | 450 | 1 | " | " | 1 | Reference Example |
| 162 | " | " | " (200) | 550 | 1 | " | " | 2 | Reference Example |
| 163 | " | " | " (200) | " | 0.5 | " | " | 2 | Reference Example |
| 164 | " | " | " (200) | " | 0.2 | " | " | 2 | Reference Example |

As is apparent from Tables 8 and 9, Sample Nos. 137 to 152, in which diffusion accelerating treatment is performed in preferred conditions, are superior in wear resistance to Sample Nos. 153 to 164 (reference example). In particular, Sample Nos. 140, 141, 143, 144, 148, 149, 151 and 152 (inventive example), in which the heat-treatments are performed for 0.2–0.5 hr at 500°–600° C., exhibit very excellent wear resistance. On the other hand, Sample Nos. 153 to 156 (reference example), in which diffusion accelerating treatment is not performed, are inferior in wear resistance to Sample Nos. 137 to 152. In Sample Nos. 157 to 160, diffusion accelerating treatment is performed but the thickness of a plating layer is as small as 0.1 μm, failing to sufficiently form a mixed layer of the base member and the plating layer, resulting in the insufficient wear resistance. In Sample Nos. 161 to 164, glass beads are used as spherical fine particles for diffusion accelerating treatment and thereby a mixed layer of the base member and the plating layer is not formed, with a result that the wear resistance is not improved.

EXAMPLE 3

Each of commercial round bars of Ti-6Al-4V alloy, Ti-15Mo-5Zr-3Al alloy, Ti-13V-11Cr-3Al alloy, Ti- 15V-3Cr-3Sn-3Al alloy, pure titanium, Ti-5Al-2.5Sn Ti-8Al-1Mo-1V alloy was machined in a test piece 1 having a shape shown in FIG. 10. A surface 2 to be evaluated, of the test piece 1 was subjected to surface roughening treatment by degreasing and acid-pickling, to diffusion accelerating treatment as needed, and to Ni—P electroplating. The test piece 1 was heat-treated under a specified condition, and subjected to dry honing treatment using glass beads having an average particle size of 200 μm. The test piece 1 was evaluated in terms of wear resistance. The evaluation and the ranking of the wear resistance were performed in the same manner as in Example 1.

The evaluated results of wear resistance are shown in Tables 10 and 11. In Sample Nos. 165–188 shown in Tables 10 and 11, the base members were made of Ti-6Al-4V alloy, Ti-15Mo-5Zr-3Al alloy, Ti-13V-11Cr-3Al alloy and Ti-15V-3Cr-3Sn-3Al alloy. However, the effect of the present invention is due to the presence of the β-titanium phase in the titanium alloy, and therefore, the same effect can be obtained even in the case of using (α+β) or β-titanium alloys.

TABLE 10

| No. | Base material | Diffusion accelerating treatment: Plating thickness, μm | Diffusion accelerating treatment: Fine particles for honing treatment | Heat treatmenta: Temperature, °C | Heat treatmenta: Time, h | Honing treatment: Fine particles | Honing treatment: Average particle size, μm | Wear resistance | Remarks |
|---|---|---|---|---|---|---|---|---|---|
| 165 | Ti-6Al-4V | " | " | 450 | 1 | Glass beads | 200 | 4 | Inventive Example |
| 166 | " | " | | 500 | 0.5 | " | " | 4 | Inventive Example |
| 167 | " | " | " | 550 | 0.5 | " | " | 4 | Inventive Example |
| 168 | " | 1 | Alumina (200*) | 450 | 1 | " | " | 1 | Inventive Example |
| 169 | ""Alumina | 500 | 0.5 (200*) | " | " | 5 | Inventive | | Example |
| 170 | " | " | Alumina | 550 | 0.5 | " | " | 5 | Inventive |

TABLE 10-continued

| No. | Base material | Diffusion accelerating treatment: Plating thickness, μm | Diffusion accelerating treatment: Fine particles for honing treatment | Heat treatmenta: Temperature, °C | Heat treatmenta: Time, h | Honing treatment: Fine particles | Honing treatment: Average particle size, μm | Wear resistance | Remarks |
|---|---|---|---|---|---|---|---|---|---|
| | | | (200*) | | | | | | Example |
| 171 | Ti-15Mo-5Zr-3Al | — | Alumina (200*) | 450 | 1 | " | " | 5 | Inventive Example |
| 172 | Ti-15Mo-5Zr-3Al | " | Alumina (200*) | 500 | 0.5 | " | " | 6 | Inventive Example |
| 173 | Ti-15Mo-5Zr-3Al | " | Alumina (200*) | 550 | 0.5 | "" | 6 | Inventive | Example |
| 174 | Ti-15Mo-5Zr-3Al | " | Alumina (200) | 450 | 1 | " | " | 5 | Inventive Example |
| 175 | Ti-15Mo-5Zr-3Al | " | Alumina (200) | 500 | 0.5 | " | " | 6 | Inventive Example |
| 176 | Ti-15Mo-5Zr-3Al | " | Alumina (200) | 550 | 0.5 | " | " | 6 | Inventive Example |
| 177 | Ti-13V-11Cr-3Al | — | —450 | 1 | " | " | 4 | Inventive | Example |
| 178 | Ti-13V 11Cr-3al | " | " | 500 | 0.5 | " | " | 5 | Inventive Example |
| 179 | Ti-13V 11Cr-3Al | " | " | 550 | 0.5 | " | " | 5 | Inventive Example |
| 180 | " 11Cr-3Al | 1 | Alumina (200) | 450 | 1 | " | 200 | 6 | Inventive Example |
| 181 | Ti-13V-11Cr-3Al | 1 | Alumina (200) | 550 | 0.5 | "" | 6 | Inventive | Example |
| 182 | Ti-13V-5Zr-3Al | " | Alumina (200) | 550 | 0.5 | " | " | 6 | Inventive Example |
| 183 | Ti-15V-3Cr-3Sn-3Al | — | — | 450 | 1 | " | " | 4 | Inventive Example |
| 184 | Ti-15V-3Cr-3Sn-3Al | " | " | 500 | 0.5 | " | " | 4 | Inventive Example |
| 185 | Ti-15V-3Cr-3Sn-3A1 | " | " | 550 | 0.5 | " | " | 5 | Inventive Example |
| 186 | Ti-15V-3Cr-3Sn-3Al | 1 | Alumina (200*) | 450 | 1 | " | " | 5 | Inventive Example |
| 187 | Ti-15V-3Cr-11Cr-3Al | " | " | 500 | 0.5 | " | " | 6 | Inventive Example |
| 188 | Ti-15V-3Cr-3Sn-3Al | " | Alumina | 550 (200*) | 0.5 | " | " | 6 | Inventive Example |

TABLE 11

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 189 | Pure Ti | — | — | 450 | 1 | Glass beads | 200 | 1 | Reference Example |
| 190 | " | " | " | 500 | 0.5 | " | " | 2 | Reference Example |
| 191 | " | " | " | 550 | 0.5 | " | " | 2 | Reference Example |
| 192 | " | 1 | Alumina (200) | 450 | 1 | Glass beads | 200 | 2 | Reference Example |
| 193 | " | " | Alumina (200) | 500 | 0.5 | " | " | 3 | Reference Example |
| 194 | " | " | Alumina (200) | 550 | 0.5 | " | " | 3 | Reference Example |
| 195 | Ti—5Al—2.5Sn | — | — | 450 | 1 | Glass beads | 200 | 1 | Reference Example |
| 196 | " | " | " | 480 | 0.5 | " | " | 2 | Reference Example |
| 197 | " | " | " | 500 | 0.5 | " | " | 2 | Reference Example |
| 198 | " | " | " | 550 | 0.5 | " | " | 2 | Reference |

TABLE 11-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| | | | | | | | | | Example |
| 199 | " | 1 | Almina (200) | 450 | 1 | Glass beads | 200 | 3 | Reference Example |
| 200 | " | " | Almina (200) | 500 | 0.5 | " | " | 3 | Reference Example |
| 201 | " | " | Almina (200) | 550 | 0.5 | " | " | 3 | Reference Example |
| 202 | Ti—8Al—1Mo—1V | — | — | 450 | 1 | Glass beads | 200 | 2 | Reference Example |
| 203 | " | " | " | 500 | 0.5 | " | " | 2 | Reference Example |
| 204 | " | " | " | 550 | 0.5 | " | " | 3 | Reference Example |
| 205 | " | 1 | Alumina (200) | 450 | 1 | Glass beads | 200 | 3 | Reference Example |
| 206 | " | " | Alumina (200) | 500 | 0.5 | " | " | 3 | Reference Example |
| 207 | " | " | Alumina (200) | 550 | 0.5 | " | " | 3 | Reference Example |

As is apparent from Tables 10 and 11, Sample Nos. 165 to 188 (inventive example) which satisfy the requirements of the present invention exhibit the wear resistances superior to those of Sample Nos. 189 to 207 (reference example). The reason for this is that, in each of these samples, since the base member is made of a β titanium alloy, a diffusion layer can be easily formed between a plating layer and a base member. On the other hand, in Sample Nos. 189 to 207 (reference example), since the base members are made of pure titanium or α titanium alloys, the wear resistances are insufficient because of poor diffusion.

EXAMPLE 4

Each of commercial round bars made of S45, SCM440 and SNCM439 was machined into a test piece 1 having a shape shown in FIG. 10. A surface 2 to be evaluated, of the test piece 1 was subjected to surface roughening treatment by degreasing and acid pickling, to diffusion accelerating treatment as needed, and to Ni—P electroplating. The test piece 1 was then heat-treated under a specified condition, and was subjected to honing treatment. The test piece 1 was evaluated in terms of wear resistance. The evaluation and ranking of the wear resistance were performed in the same manner as in Example 1.

The evaluated results of wear resistance are shown in Tables 12 and 13. In Sample Nos. 208 to 225 shown in Table 12, the base members are made of S45, SCM440 and SNCM439. However, since the effects of diffusion accelerating treatment and heat-treatment are effectively achieved by the fact that the base material contains iron in a large amount, and the effect of honing treatment is due to only the plating layer, the same effect can be obtained even in the case of using other iron based alloys.

TABLE 12

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 208 | S45C | — | — | 450 | 1 | Glass beads | 200 | 4 | Inventive Example |
| 209 | " | " | " | 500 | 0.5 | " | " | 5 | Inventive Example |
| 210 | " | " | " | 550 | 0.5 | " | 400 | 5 | Inventive Example |
| 211 | " | 0.5 | Alumina (200) | 450 | 1 | Glass beads | " | 4 | Inventive Example |
| 212 | " | " | Alumina (200) | 500 | 0.5 | " | " | 6 | Inventive Example |
| 213 | " | " | Alumina (200) | 550 | 0.5 | " | " | 6 | Inventive Example |
| 214 | SCM440 | — | — | 450 | 1 | Glass beads | 200 | 5 | Inventive Example |

TABLE 12-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 215 | " | " | " | 500 | 0.5 | " | " | 5 | Inventive Example |
| 216 | " | " | " | 550 | 0.5 | " | 400 | 6 | Inventive Example |
| 217 | " | 0.5 | Alumina (200) | 450 | 1 | Glass beads | 200 | 6 | Inventive Example |
| 218 | " | " | Alumina (200) | 500 | 0.5 | " | " | 6 | Inventive Example |
| 219 | " | " | Alumina (200) | 550 | 0.5 | " | " | 6 | Inventive Example |
| 220 | SNCM439 | — | — | 450 | 1 | Glass beads | 200 | 5 | Inventive Example |
| 221 | " | " | " | 500 | 0.5 | " | " | 5 | Inventive Example |
| 222 | " | " | " | 550 | 0.5 | " | 400 | 5 | Inventive Example |
| 223 | " | 0.5 | Alumina (200) | 450 | 1 | Glass beads | 200 | 6 | Inventive Example |
| 224 | " | " | Alumina (200) | 500 | 0.5 | " | " | 6 | Inventive Example |
| 225 | " | " | Alumina (200) | 550 | 0.5 | " | " | 6 | Inventive Example |

TABLE 13

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 226 | S45C | — | — | — | — | — | — | 1 | Comparative Example |
| 227 | " | " | " | 500 | 0.5 | " | " | 1 | Comparative Example |
| 228 | " | " | " | 550 | 0.5 | Glass beads | 5 | 1 | Comparative Example |
| 229 | " | " | " | 550 | 0.5 | " | 500 | 2 | Comparative Example |
| 230 | " | " | " | 550 | 0.5 | Alumina | 200 | 1 | Comparative Example |
| 231 | " | 0.1 | Alumina (200) | 450 | 1 | Glass beads | 200 | 2 | Reference Example |
| 232 | " | " | Alumina (200) | 500 | 0.5 | " | " | 3 | Reference Example |
| 233 | " | " | Alumina (200) | 550 | 0.5 | " | " | 3 | Reference Example |
| 234 | SCM440 | — | — | — | — | — | — | 1 | Comparative Example |
| 235 | " | " | " | 500 | 0.5 | " | " | 2 | Comparative Example |
| 236 | " | " | " | 550 | 0.5 | Glass beads | 5 | 1 | Comparative Example |
| 237 | " | " | " | 550 | 0.5 | " | 500 | 2 | Comparative Example |
| 238 | " | " | " | 550 | 0.5 | Zircon | 200 | 1 | Comparative Example |
| 239 | " | 0.1 | Alumina (200) | 450 | 1 | Glass beads | 200 | 2 | Reference Example |
| 240 | " | " | Alumina (200) | 500 | 0.5 | " | " | 3 | Reference Example |
| 241 | " | " | Alumina (200) | 550 | 0.5 | " | " | 3 | Reference Example |
| 242 | SNCM439 | — | — | — | — | — | — | 1 | Comparative Example |

TABLE 13-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 243 | " | " | " | 500 | 0.5 | " | " | 1 | Comparative Example |
| 244 | " | " | " | 550 | 0.5 | Glass beads | 5 | 1 | Comparative Example |
| 245 | " | " | " | 550 | 0.5 | " | 500 | 1 | Comparative Example |
| 246 | " | " | " | 550 | 0.5 | Alumina | 100 | 2 | Comparative Example |
| 247 | " | 0.1 | Alumina (200) | 450 | 1 | Glass beads | 200 | 3 | Reference Example |
| 248 | " | " | Alumina (200) | 500 | 0.5 | " | " | 3 | Reference Example |
| 249 | " | " | Alumina (200) | 550 | 0.5 | " | " | 3 | Reference Example |

As is apparent from Tables 12 and 13, Sample Nos. 208 to 225 (inventive example), which satisfy the requirements of the present invention, exhibit the wear resistances superior to those of Sample Nos. 226 to 249 (comparative example or reference example). In particular, Sample Nos. 212, 213, 217 to 219, and 223 to 225, in which diffusion accelerating treatment is performed, exhibit significantly excellent wear resistances. On the other hand, in Sample Nos. 231 to 233, 239 to 241, and 247 to 249 (reference example), diffusion accelerating treatment is performed and heat-treatment and honing treatment are performed in the same conditions as those in Sample Nos. 212, 213, 217 to 219, and 223 to 225 (inventive example), but the thickness of a plating layer for diffusion accelerating treatment is as small as 0.1 μm, with a result that the wear resistances are insufficient. In Sample Nos. 228, 236 and 244 (comparative example), the sizes of fine particles for honing treatment are excessively small, and thereby the wear resistances are insufficient. In Sample Nos. 229, 237 and 245 (comparative example), the sizes of fine particles are excessively large, and thereby the wear resistances are insufficient. In Sample Nos. 230, 238 and 246 (comparative example), since non-spherical fine particles are used, the wear resistances are poor.

EXAMPLE 5

Each of commercial round bars made of Al alloys 7075 and 2014 was machined into a test piece 1 having a shape shown in FIG. 10. A surface 2 to be evaluated, of the test piece 1 was subjected to surface roughening treatment by degreasing and acid pickling, to diffusion accelerating treatment, and to Ni—P electroplating. The test piece 1 was heat-treated under a specified condition, and was subjected to dry honing treatment. The test piece 1 was evaluated in terms of wear resistance. The evaluation and ranking of the wear resistance were performed in the same manner as in Example 1.

The evaluated results of wear resistance are shown in Tables 14 and 15. In Sample Nos. 250 to 261 (inventive example) shown in Table 14, the base members are made of Al alloys 7075 and 2014. However, since the effects of diffusion accelerating treatment and heat-treatment according to the present invention are due to the fact that the base material contain a large amount of Al, and the effect of honing treatment are exerted only on the plating layer, and therefore, other Al based alloys can be used, with the same effect.

TABLE 14

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 250 | 7075 | — | — | 150 | 1 | Glass beads | 200 | 4 | Inventive Example |
| 251 | " | " | " | 250 | 0.5 | " | " | 5 | Inventive Example |
| 252 | " | " | " | 350 | 0.5 | " | 400 | 5 | Inventive Example |
| 253 | " | 0.5 | Alumina (200) | 150 | 1 | Glass beads | " | 6 | Inventive Example |
| 254 | " | " | Alumina (200) | 200 | 0.5 | " | " | 6 | Inventive Example |
| 255 | " | " | Alumina | 350 | 0.5 | " | " | 6 | Inventive |

TABLE 14-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| | | | (200) | | | | | | Example |
| 256 | 2014 | — | — | 150 | 1 | Glass beads | 200 | 5 | Inventive Example |
| 257 | " | " | " | 250 | 0.5 | " | " | 5 | Inventive Example |
| 258 | " | " | " | 350 | 0.5 | " | 400 | 5 | Inventive Example |
| 259 | " | 0.5 | Alumina (200) | 150 | 1 | Glass beads | 200 | 6 | Inventive Example |
| 260 | " | " | Alumina (200) | 250 | 0.5 | " | " | 6 | Inventive Example |
| 261 | " | " | Alumina (200) | 350 | 0.5 | " | " | 6 | Inventive Example |
| 262 | 7075 | — | — | — | — | — | — | 1 | Comparative Example |
| 263 | " | " | " | 200 | 0.5 | " | " | 1 | Comparative Example |
| 264 | " | " | " | 350 | 0.5 | Glass beads | 5 | 1 | Comparative Example |
| 265 | " | " | " | 350 | 0.5 | " | 500 | 1 | Comparative Example |
| 266 | " | " | " | 350 | 0.5 | Alumina | 200 | 1 | Comparative Example |
| 267 | " | 0.1 | Alumina (200) | 150 | 1 | Glass beads | 200 | 3 | Reference Example |
| 268 | " | " | Alumina (200) | 250 | 0.5 | " | " | 3 | Reference Example |
| 269 | " | " | Alumina (200) | 350 | 0.5 | " | " | 3 | Reference Example |

TABLE 15

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 270 | 2014 | — | — | — | — | — | — | 1 | Comparative Example |
| 271 | " | " | " | 200 | 0.5 | " | " | 1 | Comparative Example |
| 272 | " | " | " | 350 | 0.5 | Glass beads | 5 | 2 | Comparative Example |
| 273 | " | " | " | 350 | 0.5 | " | 600 | 2 | Comparative Example |
| 274 | " | " | " | 350 | 0.5 | Zircon | 200 | 1 | Comparative Example |
| 275 | " | 0.1 | Alumina (200) | 150 | 1 | Glass beads | 200 | 3 | Reference Example |
| 276 | " | " | Alumina (200) | 250 | 0.5 | " | " | 3 | Reference Example |
| 277 | " | " | Alumina (200) | 350 | 0.5 | " | " | 3 | Reference Example |

As is apparent from Tables 14 and 15, Sample Nos. 250 to 261 (inventive example) which satisfy the requirements of the present invention, exhibit wear resistances superior to those of Sample Nos. 262 to 266 and 270 to 277 (comparative example). In particular, Sample Nos. 253 to 255, and 259 to 261, in which diffusion accelerating treatment is performed, exhibit significantly excellent wear resistances. On the other hand, in Sample Nos. 267 to 269 and 275 to 277 (reference example), diffusion accelerating treatment is performed and heat-treatment and honing treatment are performed in the same conditions as those in Sample Nos. 253 to 255, and 259 to 261 (inventive example) but the thickness of a plating layer for diffusion accelerating treatment is as small as 0.1 μm, with a result that the wear resistances are insufficient. In Sample Nos. 264 and 272 (comparative example), the sizes of fine particles are excessively small for honing treatment, and thereby the wear resistances are poor. In Sample Nos. 265 and 275, the sizes of fine particles are large, and thereby the wear resistances are poor. In Sample Nos. 266 and 274 (comparative example), since non-spherical fine particles are used for honing treatment, the wear resistances are poor.

EXAMPLE 6

Each of ingots made of Ti-6Al-4V alloy and Ti-15Mo-5Zr-3Al alloy was forged and heat-treated, to prepare a connecting rod for an automobile engine. The connecting rod was subjected to surface roughening treatment by degreasing and acid pickling, to diffusion accelerating treatment, and to Ni—P electroplating by a thickness of 300 μm. The connecting rod was heat-treated under a specified condition, and was subjected honing treatment in a specified condition. The connecting rod was then tested by the following manner: namely, it was mounted on a commercial automobile engine of a displacement of 2000 cc modified for bench testing; the engine was continuously operated for 10 days at a rotational speed of 5500 rpm; and the wear resistance was evaluated on the basis of the wear amount generated in this test.

The measured results are shown in Table 16. The wear resistance shown in Table 16 is comparatively evaluated. A difference between the maximum wear amount and the minimum wear amount is divided into equal six divisions, and the wear resistance is ranked in the same manner as in Example 1.

TABLE 16

| | | Diffusion accelerating treatment | | Heat treatment | | Honing treatment | | | |
|---|---|---|---|---|---|---|---|---|---|
| No. | Base material | Plating thickness, μm | Fine paricles for honing treatment | Temperature, °C. | Time, h | Fine particles | Average particle size, μm | Wear resistance | Remarks |
| 278 | Ti—6Al—4V | — | — | 450 | 1 | Glass beads | 200 | 4 | Inventive Example |
| 279 | " | " | " | 500 | 0.5 | " | " | 4 | Inventive Example |
| 280 | " | " | " | 550 | 0.5 | " | " | 5 | Inventive Example |
| 281 | " | 1 | Alumina (200) | 450 | 1 | Glass beads | 200 | 4 | Inventive Example |
| 282 | " | " | Alumina (200) | 500 | 0.5 | " | " | 5 | Inventive Example |
| 283 | " | " | Alumina (200) | 550 | 0.5 | " | " | 5 | Inventive Example |
| 284 | Ti—15Mo—5Zr—3Al | — | — | 450 | 1 | Glass beads | 200 | 5 | Inventive Example |
| 285 | " | " | " | 500 | 0.5 | " | " | 6 | Inventive Example |
| 286 | " | " | " | 550 | 0.5 | " | " | 6 | Inventive Example |
| 287 | " | 1 | Alumina (200) | 450 | 1 | Glass beads | 200 | 6 | Inventive Example |
| 288 | " | " | Alumina (200) | 500 | 0.5 | " | " | 6 | Inventive Example |
| 289 | " | " | Alumina (200) | 550 | 0.5 | " | " | 6 | Inventive Example |
| 290 | Ti—6Al—4V | — | — | — | — | — | — | 1 | Comparative Example |
| 291 | Ti—6Al—4V | — | — | 550 | 0.5 | Glass beads | 5 | 2 | Comparative Example |
| 292 | " | " | " | " | " | " | 500 | 2 | Comparative Example |
| 293 | " | " | " | " | " | Alumina | 200 | 1 | Comparative Example |
| 294 | " | " | " | " | " | Cut-wire shot | 600 | 1 | Comparative Example |
| 295 | " | 1 | Alumina (200) | 550 | 0.5 | Glass beads | 5 | 3 | Comparative Example |
| 296 | " | " | Alumina (200) | " | " | " | 500 | 3 | Comparative Example |
| 297 | " | " | Alumina (200) | " | " | Alumina | 200 | 1 | Comparative Example |
| 298 | " | " | " | " | " | Cut-wire shot | 600 | 1 | Comparative Example |

As is apparent from Table 16, Sample Nos. 278 to 289 (inventive example), which satisfy the requirements of the present invention, exhibit the wear resistances superior to those of Sample Nos. 290 to 298 (comparative example). In particular, Sample Nos. 285, 286, 288 and 289, in which Ti-15Mo-5Zr-3Al alloy is used as the base material and heat-treatments are performed for 0.5 hr at a temperature of 500° C. or more, exhibit significantly excellent wear resistances. From this experiment, it is revealed that the present invention is useful as a wear resisting surface treatment performed on a connecting rod made of titanium alloy.

EXAMPLE 7

An ingot made of Ti-6Al-4V alloy was forged, heat-treated and machined, to prepare a valve spring retainer for an automobile engine. The retainer was subjected to surface toughening treatment by degreasing and acid pickling, to diffusion accelerating treatment, and to Ni—P electroplating by a thickness of 30 μm. The retainer was heat-treated under a specified condition, and was subjected to dry honing treatment in a specified condition. The retainer was tested by the following manner: namely, it was mounted on a commercial automobile engine of a displacement of 2000 cc modified for bench testing, and the engine was continuously operated for 10 days at a rotational speed of 5500 rpm; and the wear resistance was evaluated on the basis of the wear amount generated in this test. The measured results are shown in Table 17. The wear resistance shown in Table 17 is comparatively evaluated. A difference between the maximum wear amount and the minimum wear amount is divided into equal six divisions, and the wear resistance is ranked in the same manner as in Example 1.

TABLE 17

| | | Diffusion accelerating treatment | | Heat treatment | | Honing treatment | | | |
|---|---|---|---|---|---|---|---|---|---|
| No. | Base material | Plating thickness, μm | Fine paricles for honing treatment | Temperature, °C. | Time, h | Fine particles | Average particle size, μm | Wear resistance | Remarks |
| 299 | Ti—6Al—4V | — | — | 450 | 1 | Glass beads | 200 | 4 | Inventive Example |
| 300 | " | " | " | 500 | 0.5 | " | " | 5 | Inventive Example |
| 301 | " | " | " | 550 | 0.5 | " | " | 5 | Inventive Example |
| 302 | " | 1 | Alumina (200) | 450 | 1 | Glass beads | 200 | 6 | Inventive Example |
| 303 | " | " | Alumina (200) | 500 | 0.5 | " | " | 6 | Inventive Example |
| 304 | " | " | Alumina (200) | 550 | 0.5 | " | " | 6 | Inventive Example |
| 305 | Ti—6Al—4V | — | — | — | — | — | — | 1 | Comparative Example |
| 306 | Ti—6Al—4V | — | — | 550 | 0.5 | Glass beads | 5 | 1 | Comparative Example |
| 307 | " | " | " | " | " | " | 500 | 2 | Comparative Example |
| 308 | " | " | " | " | " | Alumina | 200 | 1 | Comparative Example |
| 309 | " | " | " | " | " | Cut-wire shot | 600 | 1 | Comparative Example |
| 310 | " | 1 | Alumina (200) | 550 | 0.5 | Glass beads | 5 | 3 | Comparative Example |
| 311 | " | " | Alumina (200) | " | " | " | 500 | 3 | Comparative Example |
| 312 | " | " | Alumina (200) | " | " | Alumina | 200 | 2 | Comparative Example |
| 313 | " | " | Alumina (200) | " | " | Cut-wire shot | 600 | 2 | Comparative Example |

As is apparent from Table 17, Sample Nos. 299 to 304 (inventive example), which satisfy the requirements of the present invention, exhibit the wear resistances superior to those of Sample Nos. 305 to 313 (comparative example). In particular, Sample Nos. 302 to 304, in which diffusion accelerating treatment is performed, exhibit significantly excellent wear resistances. From this experiment, it is revealed that the present invention is useful as a wear resisting surface treatment performed on a valve spring retainer made of a titanium alloy.

EXAMPLE 8

Each of ingots made of Ti-6Al-4V alloy, Ti-15Mo-5Zr-3Al alloy and Ti-13V-11Cr-3Al alloy was forged, drawn and heat-treated, to prepare a valve spring for an automobile engine. The valve spring was subjected to surface roughening treatment by degreasing and acid pickling, to diffusion accelerating treatment, and to Ni—P electroplating by a thickness of 20 μm. The valve spring was heat-treated under a specified condition, and was subjected to honing treatment in a specified condition. The valve spring was tested by the following manner; namely, it was mounted on a commercial automobile engine of a displacement of 2000 cc modified for bench testing; the engine was continuously operated for 10 days at a rotational speed of 5500 rpm; and the wear resistance was evaluated on the basis of the wear amount generated in this test.

The measured results are shown in Tables 18 and 19. The wear resistance shown in Tables 18 and 19 is comparatively evaluated. A difference between the maximum wear amount and the minimum wear amount is divided into equal six divisions, and the wear resistance is ranked in the same manner as in Example 1.

TABLE 18

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 314 | Ti—6Al—4V | — | — | 450 | 1 | Glass beads | 200 | 4 | Inventive Example |
| 315 | " | " | " | 500 | 0.5 | " | " | 4 | Inventive Example |
| 316 | " | " | " | 550 | 0.5 | " | " | 4 | Inventive Example |
| 317 | " | 1 | Alumina (200) | 450 | 1 | " | " | 5 | Inventive Example |
| 318 | " | " | Alumina (200) | 500 | 0.5 | " | " | 5 | Inventive Example |
| 319 | " | " | Alumina (200) | 550 | 0.5 | " | " | 5 | Inventive Example |
| 320 | Ti—15Mo—5Zr—3Al | — | — | 450 | 1 | Glass beads | 200 | 5 | Inventive Example |
| 321 | " | " | " | 500 | 0.5 | " | " | 6 | Inventive Example |
| 322 | " | " | " | 550 | 0.5 | " | " | 6 | Inventive Example |
| 323 | " | 1 | Alumina (200) | 450 | 1 | " | " | 6 | Inventive Example |
| 324 | " | " | Alumina (200) | 500 | 0.5 | " | " | 6 | Inventive Example |
| 325 | " | " | Alumina (200) | 550 | 0.5 | " | " | 6 | Inventive Example |
| 326 | Ti—13V—11Cr—3Al | — | — | 450 | 1 | Glass beads | 200 | 6 | Inventive Example |
| 327 | " | " | " | 500 | 0.5 | " | " | 6 | Inventive Example |
| 328 | " | " | " | 550 | 0.5 | " | " | 6 | Inventive Example |
| 329 | " | 1 | Alumina (200) | 450 | 1 | " | " | 6 | Inventive Example |
| 330 | " | " | Alumina (200) | 500 | 0.5 | " | " | 6 | Inventive Example |
| 331 | " | " | Alumina (200) | 550 | 0.5 | " | " | 6 | Inventive Example |

TABLE 19

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 332 | Ti—6Al—4V | — | — | — | — | — | — | 1 | Comparative Example |
| 333 | Ti—6Al—4V | — | — | 550 | 0.5 | Glass beads | 5 | 2 | Comparative Example |
| 334 | " | " | " | " | " | " | 500 | 2 | Comparative Example |
| 335 | " | " | " | " | " | Alumina | 200 | 1 | Comparative Example |
| 336 | " | " | " | " | " | Cut-wire shot | 600 | 1 | Comparative Example |
| 337 | " | 1 | Alumina (200) | 550 | 0.5 | Glass beads | 5 | 3 | Comparative Example |
| 338 | " | " | Alumina (200) | " | " | " | 500 | 3 | Comparative Example |
| 339 | " | " | Alumina (200) | " | " | Alumina | 200 | 2 | Comparative Example |
| 340 | " | " | " | " | " | Cut-wire | 600 | 2 | Comparative |

TABLE 19-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| | | | | | | shot | | | Example |
| 341 | Ti—15Mo—5Zr—3Al | — | — | 450 | 1 | Glass beads | 5 | 2 | Comparative Example |
| 342 | " | 1 | Alumina (200) | 500 | 0.5 | Cut-wire shot | 200 | 2 | Comparative Example |
| 343 | Ti—13V—11Cr—3Al | — | — | 450 | 1 | Glass beads | 500 | 2 | Comparative Example |
| 344 | " | 1 | Alumina (200) | 500 | 0.5 | Cut-wire shot | 600 | 2 | Comparative Example |

As is apparent from Tables 18 and 19, Sample Nos. 314 to 331 (inventive example), which satisfy the requirements of the present invention, exhibit the wear resistances superior to those of Sample Nos. 332 to 344 (comparative example). In particular, Sample Nos. 320 to 331, in which β alloys are used, exhibit significantly excellent wear resistances. From this experiment, it is revealed that the present invention is useful as a wear resisting surface treatment performed on a valve spring made of a titanium alloy.

EXAMPLE 9

Each of front gears for a bicycle (mountain bike) made of commercial Al alloys 7075 and 2014 was subjected to surface roughening treatment by degreasing and acid pickling, to diffusion accelerating treatment, and to Ni—P plating by a thickness of 30 μm. The front gear was heat-treated under a specified condition, and was subjected to dry honing treatment under a specified condition. The front gear was tested by the following manner: namely, it was mounted on a commercial mounting bike; the gear was rotated at a rotational speed of 200 rpm while a solution of sands suspended in water at a ratio of 100 g per 1 of water was sprayed to the gear; and the wear resistance was evaluated on the basis of the wear amount after an elapse of 2 hr in this test. The measured results are shown in Table 20. The wear resistance shown in Table 20 is comparatively evaluated. A difference between the maximum wear amount and the minimum wear amount is divided into equal six divisions, and the wear resistance is ranked in the same manner as in Example 1.

TABLE 20

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 345 | 7075 | — | — | 150 | 1 | Glass beads | 200 | 4 | Inventive Example |
| 346 | " | " | " | 250 | 0.5 | " | " | 4 | Inventive Example |
| 347 | " | " | " | 350 | 0.5 | Glass beads | " | 5 | Inventive Example |
| 348 | " | 1 | Alumina (200) | 150 | 1 | Glass beads | 200 | 6 | Inventive Example |
| 349 | " | " | Alumina (200) | 250 | 0.5 | " | " | 6 | Inventive Example |
| 350 | " | " | Alumina (200) | 350 | 0.5 | " | " | 6 | Inventive Example |
| 351 | 2014 | — | — | 150 | 1 | Glass beads | 200 | 5 | Inventive Example |
| 352 | " | " | " | 250 | 0.5 | " | " | 5 | Inventive Example |
| 353 | " | " | " | 350 | 0.5 | " | " | 6 | Inventive Example |
| 354 | " | 1 | Alumina (200) | 150 | 1 | Glass beads | 200 | 6 | Inventive Example |
| 355 | " | " | " (200) | 250 | 0.5 | " | " | 6 | Inventive Example |
| 356 | " | " | Alumina (200) | 350 | 0.5 | " | " | 6 | Inventive Example |
| 357 | 7075 | — | — | — | — | — | — | 1 | Comparative Example |

TABLE 20-continued

| No. | Base material | Diffusion accelerating treatment: Plating thickness, μm | Diffusion accelerating treatment: Fine paricles for honing treatment | Heat treatment: Temperature, °C. | Heat treatment: Time, h | Honing treatment: Fine particles | Honing treatment: Average particle size, μm | Wear resistance | Remarks |
|---|---|---|---|---|---|---|---|---|---|
| 358 | 7075 | — | — | 350 | 0.5 | Glass beads | 5 | 1 | Comparative Example |
| 359 | " | " | " | " | " | " | 500 | 2 | Comparative Example |
| 360 | " | " | " | " | " | Alumina | 200 | 1 | Comparative Example |
| 361 | " | " | " | " | " | Cut-wire shot | 600 | 1 | Comparative Example |
| 362 | " | 1 | Alumina (200) | 350 | 0.5 | Glass beads | 5 | 3 | Comparative Example |
| 363 | " | " | Alumina (200) | " | " | " | 500 | 3 | Comparative Example |
| 364 | " | " | Alumina (200) | " | " | Alumina | 200 | 2 | Comparative Example |
| 365 | " | " | Alumina (200) | " | " | Cut-wire shot | 600 | 1 | Comparative Example |
| 366 | 2014 | | | Hard alumite treatment | | | | 2 | Comparative Example |
| 367 | 7075 | | | " | | | | 2 | Comparative Example |

As is apparent from Table 20, Sample Nos. 345 to 356 (inventive example), which satisfy the requirements of the present invention, exhibit wear resistances superior to those of Sample Nos. 357 to 367 (comparative example). In particular, Sample Nos. 348, 350, and 354 to 356, in which diffusion accelerating treatment is performed, exhibit significantly excellent wear resistances. From this experiment, it is revealed that the present invention is useful as a wear resisting surface treatment performed on a member to be rubbed with hard particles such as a bicycle gear made of an aluminum alloy.

What is claimed is:

1. A method of manufacturing a surface treated metal member wherein said surface treated metal member has an excellent resistance against sliding wear, rolling wear, line wear and wear fatigue, comprising the steps of: applying Ni—P electroplating on the surface of a metal base member to form an electroplate surface and heat-treating said metal base member for 0.1–1 hr at 500°–600° C.; and shot peening, on said electroplated surface of said metal base member, fine particles without sharp corners and having an average particle size of 10–400 μm.

2. A method of manufacturing a surface treated metal member according to claim 1, wherein said shot peening is performed using fine particles having spherical shapes.

3. A method of manufacturing a surface treated metal member according to claim 1, wherein prior to applying said Ni—P electroplating, Ni-based plating is performed on the surface of said metal base member to a thickness of 0.5–5 μm.

* * * * *